US006854729B2

(12) United States Patent
Yamaguchi

(10) Patent No.: US 6,854,729 B2
(45) Date of Patent: Feb. 15, 2005

(54) PLAY MEDIA SHOOTING MACHINE WITH IMPROVED STOP CONTROL

(75) Inventor: Shinsuke Yamaguchi, Kiryu (JP)

(73) Assignee: Kabushiki Kaisha Sankyo, Gunma (JP)

( * ) Notice: Subject to any disclaimer, the term of this patent is extended or adjusted under 35 U.S.C. 154(b) by 180 days.

(21) Appl. No.: 09/986,651

(22) Filed: Nov. 9, 2001

(65) Prior Publication Data

US 2002/0090989 A1 Jul. 11, 2002

(30) Foreign Application Priority Data

Nov. 15, 2000 (JP) ..... 2000-348681
Nov. 20, 2000 (JP) ..... 2000-353259
Nov. 21, 2000 (JP) ..... 2000-354957
Nov. 21, 2000 (JP) ..... 2000-354958

(51) Int. Cl.[7] ..... A63F 7/02
(52) U.S. Cl. ..... 273/121 B; 463/16
(58) Field of Search ..... 273/118 R, 121 B, 273/138.1, 138.2, 138.3, 459–461, 348, 351, 354, 359, 362, 364, 371, 378, 379, 381, 382, 386, 398, 400, 401–402, 126 R, 126 A, 127 R, 129 R, 129 Q, 129 AP, 129 S, 129 T, 129 V, 129 W, 139; 463/1–5, 7, 16–20, 24, 25, 29–30, 35–36, 49–57

(56) References Cited

U.S. PATENT DOCUMENTS 4,840,375 A * 6/1989 Lawlor et al. ..... 273/121 A
5,016,879 A * 5/1991 Parker et al. ..... 273/126 A
5,046,736 A * 9/1991 Bridgeman et al. ..... 463/13
5,131,655 A * 7/1992 Ugawa ..... 273/121 B
5,509,655 A * 4/1996 Ugawa ..... 273/121 B
5,836,819 A 11/1998 Ugawa
6,068,552 A * 5/2000 Walker et al. ..... 463/21
6,416,053 B1 * 7/2002 Kamimura ..... 273/121 B
2002/0094856 A1 * 7/2002 Bennett et al. ..... 463/16
2003/0114217 A1 * 6/2003 Walker et al. ..... 463/20
2003/0144052 A1 * 7/2003 Walker et al. ..... 463/20

FOREIGN PATENT DOCUMENTS

| | | |
|---|---|---|
| JP | 5-31229 | 2/1993 |
| JP | 6-47133 | 2/1994 |
| JP | 6-63222 | 3/1994 |
| JP | 6-339560 | 12/1994 |
| JP | 7-246268 | 9/1995 |
| JP | 8-318024 | 12/1996 |
| JP | 8-318025 | 12/1996 |
| JP | 8-322980 | 12/1996 |
| JP | 11-76504 | 3/1999 |
| JP | 11-76505 | 3/1999 |
| JP | 11-76506 | 3/1999 |

* cited by examiner

*Primary Examiner*—Scott E. Jones
(74) *Attorney, Agent, or Firm*—McDermott Will & Emery LLP

(57) ABSTRACT

The game machine includes a start detection unit for detecting an input from a user to start shooting balls, a shooting control unit for initiating shooting the balls in response to the start detection unit detecting the relevant input from the user and for controlling to stop shooting the balls in response to all the available balls having been shot, and a stop detection unit for detecting an input from the user to stop shooting the balls. The control unit controls to stop shooting the balls in response to the stop detection unit detecting the relevant input from the user. Thus, manipulability for shooting balls is improved. Further, a game well reflecting the player's intention to stop shooting the balls is provided.

7 Claims, 16 Drawing Sheets

FIG.9

| ROUTE X | WINNING HOLE | WIN | DETERMINATION DATA 000 | … | 00A | 01A | … | 11F |
|---|---|---|---|---|---|---|---|---|
| ROUTE A0 | A | × | | | 1～80 | — | | |
| ROUTE A1 | A | ○ | | | — | 1～80 | | |
| ROUTE B0 | B | × | | | 81～83 | — | | |
| ROUTE B1 | B | ○ | | | — | — | | |
| ROUTE C0 | C | × | | | 84～86 | — | | |
| ROUTE C1 | C | ○ | | | — | 81～83 | | |
| ROUTE D0 | D | × | | | 87～90 | — | | |
| ROUTE D1 | D | ○ | | | — | 84～86 | | |
| ・<br>・<br>・ | | | | * ROUTE DETERMINING RANDOM NUMBER R2 = 1～100 | | | | |
| ROUTE G0 | — | × | | | 96 | — | | |
| ROUTE G1 | — | × | | | 97 | — | | |
| ・<br>・<br>・ | | × | | | | | | |
| | | | NORMAL PLAY STATE LOSING BALL NON-DESIGNATED | | NORMAL PLAY STATE LOSING BALL DESIGNATED: A | NORMAL PLAY STATE WINNING BALL DESIGNATED: A | | SPECIFIC PLAY STATE WINNING BALL DESIGNATED: F |

| DETERMINATION DATA | FIRST DIGIT | SECOND DIGIT | THIRD DIGIT |
|---|---|---|---|
| | PLAY STATE | WINNING BALL OR LOSING BALL | DESIGNATED OR NON-DESIGNATED |
| | 0: NORMAL PLAY STATE<br>1: SPECIFIC PLAY STATE | 0: LOSING BALL<br>1: WINNING BALL | 0: WINNING HOLE IS NOT DESIGNATED<br>X: WINNING HOLE X IS DESIGNATED |

PLAY MEDIA SHOOTING MACHINE WITH IMPROVED STOP CONTROL

BACKGROUND OF THE INVENTION

1. Field of the Invention

The present invention relates to game machines such as Pachinko game machines and coin game machines, and more particularly to a game machine provided with a casing and a play field including a winning region into which a play medium can enter to achieve a win.

2. Description of the Background Art

As a conventional game machine of the above-described type, the game machine wherein balls are flipped into a play field upon manipulation of a start button is known. The game machine of this type has an advantage that a player does not need to adjust strength of the shooting, thereby reducing the player's labor.

It however has a disadvantage that, since the balls are shot off continuously until a predetermined number of balls are all flipped, little room is left for reflecting the player's intention.

In particular, the timing at which a player wants to stop shooting the balls to finish the game varies with the individual. Failure to choose such a desired timing would increase the player's frustration.

SUMMARY OF THE INVENTION

The present invention has been made to solve the foregoing problems. An object of the present invention is to provide a game machine that allows a player to play a game in a manner reflecting the player's intention to the utmost, while reducing the player's labor.

To achieve the above-described object, the game machine according to an aspect of the present invention provided with a casing and a play field having a winning region into which a play medium can enter to achieve a win includes: a storage unit which stores the number of available play media for shooting into the play field; a start detection unit which detects an input from a user to start shooting the play media into the play field; a shooting control unit which initiates shooting the play media into the play field in response to the start detection unit detecting the input from the user to start shooting the play media and controls to stop shooting the play media in response to all the available play media having been shot; and a stop detection unit which detects an input from the user to stop shooting the play media. The shooting control unit controls to stop shooting the play media in response to the stop detection unit detecting the input from the user to stop shooting the play media.

According to the present invention, the shooting operation of the play media is started by an input from a user to start shooting the play media. Thus, it is unnecessary to control shooting of every play medium, which alleviates the player's labor required to play the game. Further, the shooting of the play media can be stopped any time in accordance with the player's intention.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 9 shows exemplary data in a route table.

DESCRIPTION OF THE PREFERRED EMBODIMENTS

Hereinafter, embodiments of the present invention will be described with reference to the drawings. Although a Pachinko game machine is described as an example of the game machine, the present invention is not limited to the Pachinko game machine, but may be a coin game machine or the like. The present invention is applicable to any game machine provided with a casing and a play field having a winning region into which a play medium can enter to achieve a win.

First Embodiment

Figure 1:
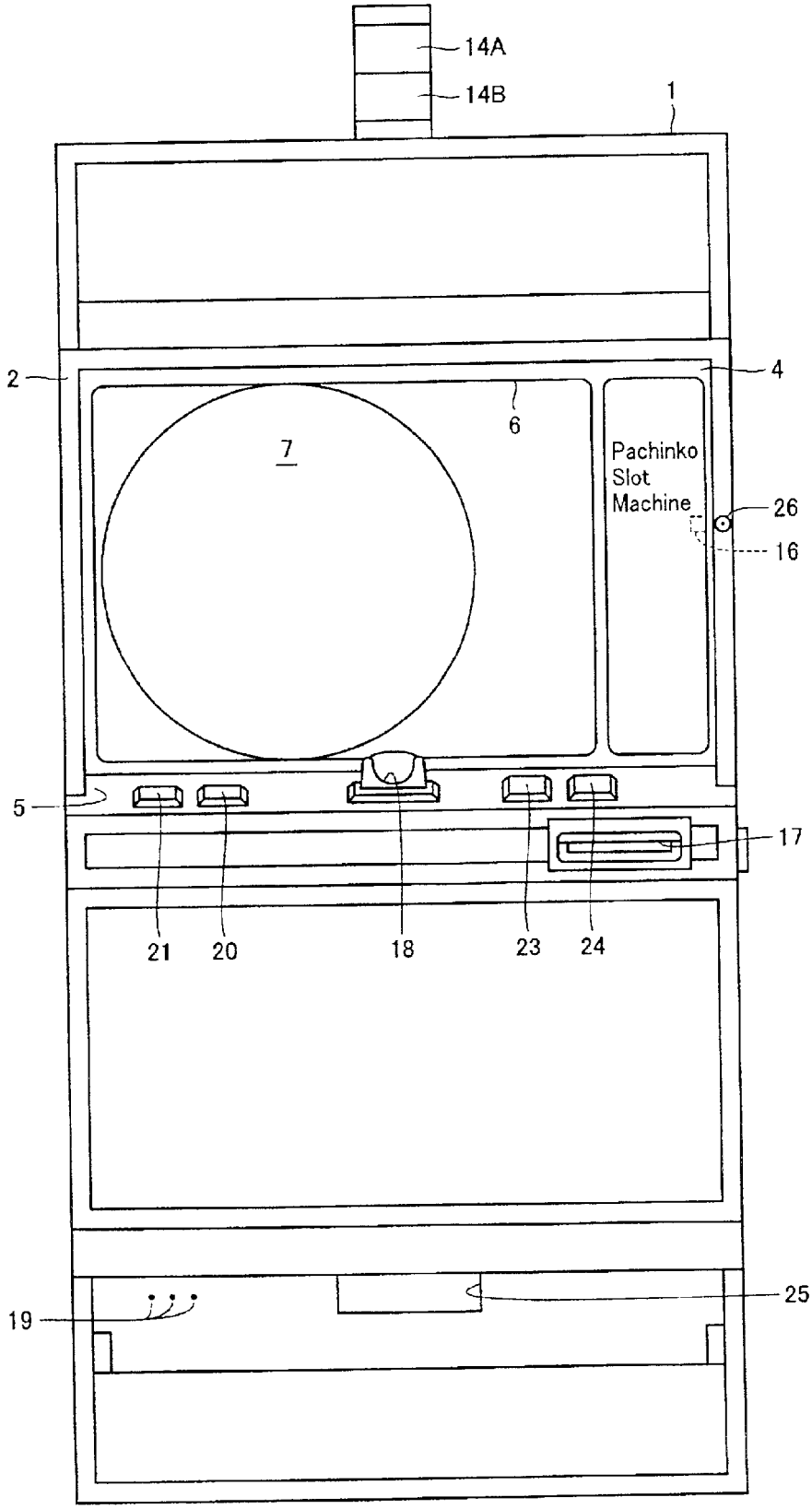
FIG. 1 is an entire front view of the game machine.

FIG. 1 is an entire front view showing an image display type game machine 1 as an example of the game machine according to the present invention.

A front frame 2 is provided in game machine 1. A glass door frame (metal frame) 4 and a front cover plate 5 are provided to front frame 2 in such a manner that they can be opened/closed freely. An image display region 6 is formed of an image display of a CRT display device, for example, that is mounted to game machine 1 at the middle of its backside. Image display region 6 is covered with a touch screen 60 (see FIG. 2), as will be described later.

A key hole 26 is provided in front frame 2. When an attendant of the game hall inserts a prescribed key into key hole 26 and turns it to the left in the drawing, glass door frame 4 is unlocked and attains an openable state. Opening of glass door frame 4 is detected by a metal frame opening switch 16.

A coin selector and a coin sorter (both not shown) are provided at the backside of front cover plate 5. The coin selector has functions to determine whether the coin inserted via a coin inlet 18 is a proper coin, to reject an improper coin to be output from a coin outlet 25, and, upon detection of a proper coin, to send a detection signal to a main substrate 140 (see FIG. 4).

The coin sorter has a function to distribute an inserted coin either to a hopper 138 (see FIG. 4) or to coin outlet 25.

Hopper 138 is formed integrally with game machine 1 and located at the back of front cover plate 5 to store the coins received from the coin sorter. A coin hopper motor (not shown) for driving hopper 138 is provided below hopper 138. Upon driving of this coin hopper motor, a prescribed number of coins are dispensed through coin outlet 25.

Front cover plate 5 is provided with a bill inlet 17, coin inlet 18, a loudspeaker 19, a change button 21, a cash-out button 20, a start button 23, and an end button 24.

Candle lamps 14A, 14B are provided on the top of game machine 1, which are lighted when there is some error.

Figure 2:
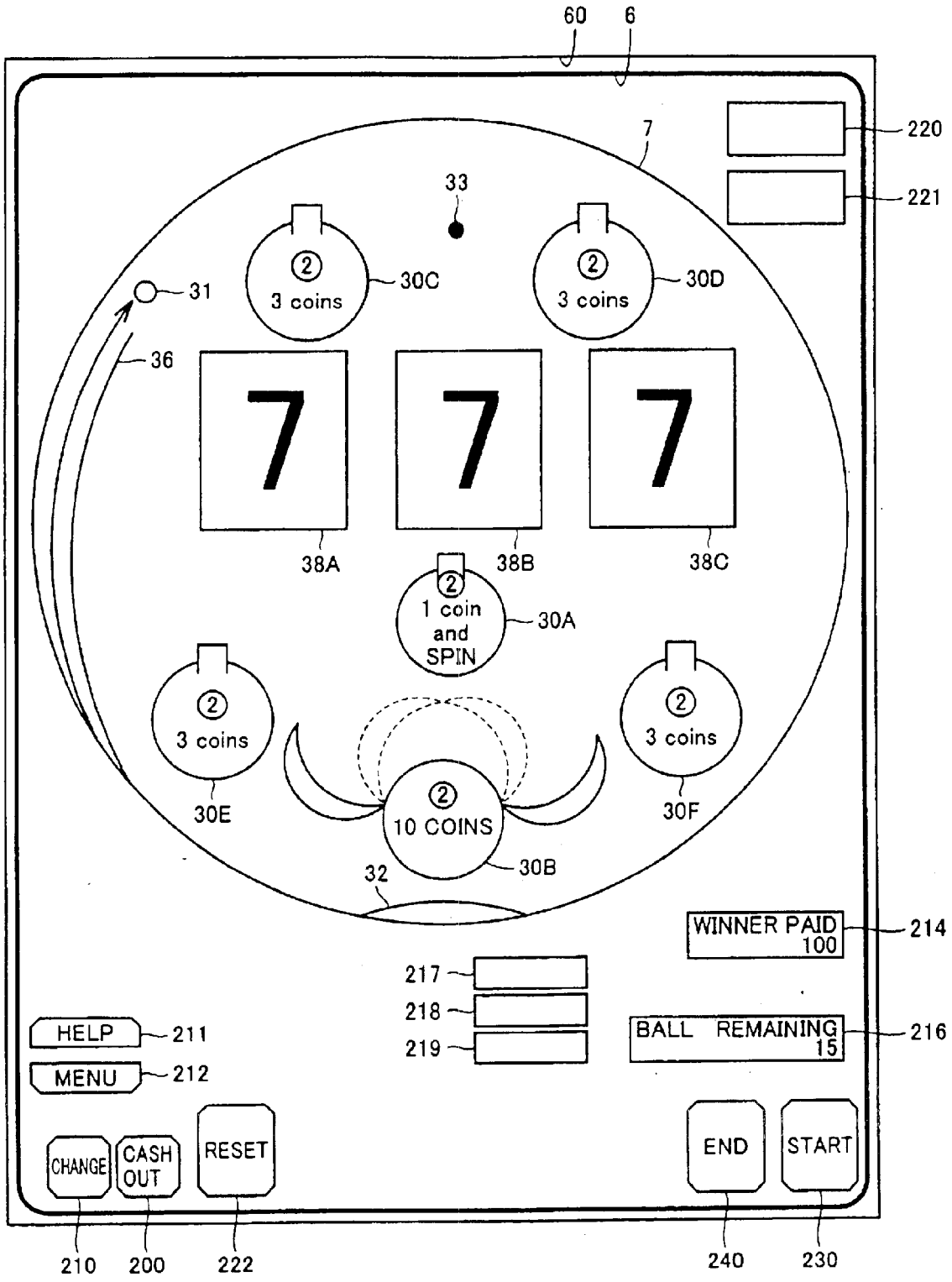
FIG. 2 is an enlarged view of the image display region.

FIG. 2 is an enlarged view of image display region 6. CRT display device 139 (see FIG. 4) displays images on image display region 6, which include the images of a play field 7, various kinds of display portions, and various kinds of operation buttons. Image display region 6 is covered with a transparent touch screen 60. Play field 7, the display portions, the operation buttons and others are made visible through touch screen 60. Touch screen 60 detects manipulations of the operation buttons displayed on image display region 6, or any other manipulation on the region 6.

A total coin-in display portion 220 and a total coin-paid display portion 221 are provided to the upper right of play field 7. The total number of coins entered into the game machine is displayed on total coin-in display portion 220. When a paper note is inserted, the value of the note is converted to the number of coins, which is added to the numerical value displayed on total coin-in display portion 220. The total number of coins awarded to the player is displayed on total coin-paid display portion 221. Calculating a difference between the numerical values displayed on these portions allows the player to check the balance. Upon manipulation of reset button 222 provided to the lower left of play field 7, the displays on total coin-in display portion 220 and total coin-paid display portion 221 are both reset to "0". Therefore, if a player resets the displays before starting the game, he/she is able to ascertain the balance of his/her own play by checking the displays on these display portions. In addition to or instead of these display portions, a balance display portion may be provided on which a difference between the total number of coins inserted and the total number of coins earned by the player is displayed.

Graphic representations of various display portions and operation buttons are provided below play field 7. An earned count (WINNER PAID) display portion 214 temporarily displays, upon winning entry of a ball into any of winning holes 30A–30F, the number of coins being awarded to the player corresponding to the relevant win. It is noted, however, that the coins are not paid out every time a win occurs, but stored within the game machine as the number of balls which are available to the player during the game. The number of balls thus stored is added to a ball count displayed on an "available ball count display portion 216", which is now described.

The available ball count (BALL REMAINING) display portion 216 displays the number of balls that can be shot without insertion of a new coin. The value displayed on this portion 216 is decremented by 1 every time a ball is flipped. When a ball enters any of winning holes 30A–30F, the number of coins awarded is displayed on WINNER PAID display portion 214, and then, the number of balls corresponding to the number of coins awarded is added to a ball count displayed on BALL REMAINING display portion 216. The display on WINNER PAID display portion 214 is reset to "0". The value displayed on BALL REMAINING display portion 216 is incremented by 1 for each coin inserted. Hereinafter, the balls whose count is displayed on BALL REMAINING display portion 216 are called "available balls" or "balls available".

A coin acceptable display portion 217 is for indicating a state where a coin is acceptable. A coin acceptance display portion 218 is for indicating that a coin inserted was accepted. A bill acceptance display portion 219 indicates that an inserted bill was accepted.

A cash-out button 200 is for settling the game result by causing coins corresponding to the number of available balls displayed on BALL REMAINING display portion 216 to be paid out to the player. In response to manipulation of this cash-out button 200, the ball count displayed on BALL REMAINING display portion 216 is decremented one by one until it reaches "0", while coins are dispensed one by one corresponding thereto. A change button 210 is for calling an attendant of the game hall. Change button 21 shown in FIG. 1 has the same function as this change button 210. Similarly, cash-out button 20 in FIG. 1 functions in the same manner as the cash-out button 200.

A help button 211 is for causing an explanatory screen of the game machine to be displayed. A menu button 212 is for causing a main menu to be displayed for selection of a play board screen, which will be described later.

A start button 230 is for starting a game. Upon manipulation of this start button 230, balls are flipped one after another into the play field automatically. Start button 23 shown in FIG. 1 has the same function as this start button 230. An end button 240 is for controlling to stop shooting the balls. End button 24 shown in FIG. 1 has the same function as this end button 240.

Play field 7 is further provided with a guide rail 36 for guiding a ball 31 flipped from the lower left portion of play field 7 upwards, reels 38A, 38B, 38C having alphanumeric characters or the like scrolled thereon, six winning holes 30A–30F, a lost ball port 32, a great number of obstructive nails or pegs 33 (of which one obstacle nail 33 is representatively shown in the drawing) for changing travel directions of the balls, and others.

The balls 31, guide rail 36, reels 38A, 38B, 38C, winning holes 30A–30F, lost ball port 32, obstructive nails 33 and others are all displayed as images on image display region 6. This eliminates possibilities of jamming of balls, malfunction of various detecting sensors, and wear of components provided in the play field 7, thereby facilitating maintenance of the game machine.

Reels 38A, 38B, 38C start scrolling upon entry of a ball into winning hole 30A. This winning hole 30A is specifically called a Spin Pocket (or, spin starter winning hole), and the entry of a ball into this Spin Pocket is called a spin starter win. If there is a spin starter win during the time period where reels 38A, 38B, 38C cannot start scrolling, e.g., while they are in the middle of scrolling at the moment, the spin starter win is stored temporarily. Once the reels 38A, 38B, 38C become ready to scroll, scrolling thereof is started based on the spin starter win stored. An upper limit may be set for the count of the spin starter wins allowed to be stored. For example, it may be configured such that any spin starter win occurring after the count of the spin starter wins stored has reached the upper limit (of 4, for example) is refrained from being stored.

A predetermined period of time after the start of scrolling, reels 38A, 38B, 38C come to a halt in this order. When display results of the reels upon halt show a predetermined, specific combination of, e.g., "777" as shown in FIG. 2, a hit is achieved, and a pair of movable fragments provided to the left and right of winning hole 30B starts opening/closing operations. This winning hole 30B repeatedly switches between a first state advantageous to the player allowing entry of a ball and a second state disadvantageous to the player suppressing the entry of the ball over a prescribed period of time. Such a state in which winning hole 30B repeatedly switches between the first and second states is called a specific play state. A state other than the specific play state is called a normal play state.

Winning hole 30B is specifically called a big winning hole or a variable winning hole, as its entrance is widely open when the hit is achieved. By comparison with Spin Pocket (or spin starter winning hole) 30A and big (or variable) winning hole 30B, winning holes 30C–30F are called normal winning holes.

When ball 31 enters any of winning holes 30A–30F, a predetermined number of coins for the relevant winning hole are awarded to the player as the available balls. The ball which enters a winning hole is called a winning ball. The ball which fails to enter any of the holes and reaches lost ball port 32 is called a losing ball. Winning holes 30A–30F each have an indication of the number of coins (or balls) being awarded for a single entry therein as "1 COIN", "10 COINS", or the like. For example, one coin is awarded for an entry into Spin Pocket 30A, 10 coins for big winning hole 30B, and 3 coins each for normal winning holes 30C–30F. Since the number of coins to be awarded for an entry into Spin Pocket 30A is set small, excessive payout of coins to the player is prevented even if the number of times of entry into the Spin Pocket 30A is increased to allow reels 38A, 38B, 38C to scroll more frequently. Accordingly, it is possible to provide a game machine having its fascinating aspect improved with increased chances of scrolling of reels 38A, 38B, 38C, while its gambling aspect is prevented from becoming too much. The number of coins being awarded may be differentiated, e.g., between normal winning holes 30C, 30D and normal winning holes 30E, 30F.

Further, winning holes 30A–30F each have a round window in which the number of times of entry therein is displayed. This winning count is reset upon manipulation of reset button 222, for example.

The characteristics of this game machine 1 will now be described. While game machine 1 is provided with two sets of operation buttons having the identical functions on front cover plate 5 and on image display region 6, the case where the buttons displayed on image display region 6 are being employed will be described representatively. It is noted that provision of such two sets of operation buttons is not a requisite to the game machine. Only one set of operation buttons may be provided either on front cover plate 5 or on image display region 6.

Initially, a person who wants to play a game on game machine 1 inserts coin(s) or paper note(s) to obtain balls. The number of balls available is displayed on BALL REMAINING display portion 216. The value displayed on total coin-in display portion 220 is incremented in response to insertion of the coin(s) or bill(s).

The game is started when start button 230 is manipulated in the presence of the available balls. Balls 31 are sequentially flipped from the lower left portion into the play field 7.

Once the game is started, balls 31 are shot continuously until the ball count displayed on BALL REMAINING display portion 216 reaches 0. However, end button 240 can be manipulated during the game to stop shooting the balls. This allows the player to confirm the displayed states of various display portions during the game without being pressed for time. End button 240 can also be manipulated to temporarily stop shooting the balls when there is at least one spin starter win stored. This gives the player plenty of time to enjoy watching the reels 38A, 38B, 38C scroll.

The ball shooting stopped by manipulation of end button 240 can be restarted by manipulating start button 230. Instead thereof, it may be configured such that the ball shooting is restarted when end button 240 is manipulated again. That is, end button 240 may be configured as a shooting pause/restart button. Alternatively, it may be configured such that the ball shooting is stopped when start button 230 is manipulated while the balls are being flipped, and the ball shooting is restarted when start button 230 is manipulated again.

Upon entry of a ball into any of winning holes 30A–30F, the number of coins awarded in response to the relevant win is displayed on WINNER PAID display portion 214 for a predetermined period of time, which is followed by increment of the values displayed on BALL REMAINING display portion 216 and total coin-paid display portion 221.

In particular, upon entry of a ball into Spin Pocket 30A, reels 38A, 38B, 38C start scrolling, affording a chance of opening of big winning hole 30B. Therefore, in the case where the count of spin starter wins is small, it may be desirable that the routes of the flipped balls are deflected toward Spin Pocket (spin starter winning hole) 30A to converge thereon. However, each player has his/her own criterion for determination as to whether the number of spin starter wins is small or not. Thus, some player may feel frustrated if the routes of balls were adjusted automatically on the machine side. This applies especially to the case where the number of coins awarded for each entry into the spin starter winning hole (Spin Pocket) is much smaller than those awarded for the other winning holes, as in the present embodiment.

In contrast, during the specific play state, every player would want the balls to be converged on big winning hole 30B.

Thus, the game machine 1 of the present embodiment is configured to allow a player to designate a winning hole on which he/she wants the balls to converge by touching the relevant hole on touch screen 60 with the finger. For example, if the player touches the image of Spin Pocket 30A, the routes of the flipped balls are deflected towards the hole 30A to converge thereon. When the player removes the finger from the screen 60, the route deflection is cancelled, and the balls are flipped in every direction. It is noted, however, that the occurrence of winning entry is controlled inside the game machine; it is determined irrelevant to the designation manipulation of the player. That is, the designation manipulation of the player does not affect the winning probability predetermined for each ball. It however affects the process of deciding into which winning hole the ball is to enter. As a result, in the case where the internal control has decided that a ball is to enter a winning hole, probability that the relevant ball is to enter Spin Pocket 30A is differentiated according to whether the player has designated the hole 30A or not. This means that the total number of coins (or balls) being awarded to the player comes to vary dependent on how he/she designates the winning hole(s). The player is required to make a severe decision whether to go after a chance to attain the specific play state by making the balls converge on Spin Pocket (the spin starter winning hole) 30A despite the small coin count being awarded for each entry therein, or to continue to play steadily without taking such a risk.

It may also be configured such that, once a player touches a winning hole on which he/she wants to converge the flipped balls, deflection of their routes toward the designated hole is maintained until he/she designates another winning hole or until a predetermined period of time has passed.

When the player wants to finish the game, he/she manipulates end button 240 to stop shooting the balls and then manipulates cash-out button 200. Accordingly, a number of coins corresponding to the value displayed on BALL REMAINING display portion 216 are dispensed to settle the game result. Alternatively, stopping of the ball shooting and subsequent account settlement may be enabled by a single manipulation of cash-out button 200. In other words, cash-out button 200 may be provided with functions to stop the ball shooting and to settle the game result. This eliminates the necessity of manipulation of end button 240 to finish the game, thereby improving convenience of the player.

When end button 240 is manipulated to finish or suspend the game, ball shooting is stopped. However, reels 38A, 38B, 38C may be scrolling at that moment, or they may start scrolling after the manipulation of end button 240 if at least one spin starter win has been stored. In such a case, if reels 38A, 38B, 38C show a specific, "hit" combination as the display results upon halt, the specific play state is attained, accompanied by opening of big winning hole 30B. The problem is that the ball shooting is already stopped. Even if the player hastily manipulates start button 230, the timing of the ball shooting would be delayed.

As such, this game machine 1 is configured to restart the ball shooting automatically, without a start manipulation, if the ball shooting is stopped at the time when the display results of reels 38A, 38B, 38C have attained a "hit" combination. This allows the player to make the best use of the chance of specific play state that does not occur frequently. However, there is a possibility that the account has already been closed and there is no ball available upon automatic restart of the ball shooting. Further, an extremely unhappy situation may arise where a player has just run out of balls at the moment of occurrence of the hit.

Accordingly, this game machine 1 is further configured to lend balls to a player in advance to permit the ball shooting, even if there is no ball available at the time when a hit has occurred. Thus, even if a player does not own a ball at the moment of the hit, he/she is unnecessary to insert coins hastily to effect a start manipulation. This improves convenience of the player, and also prevents the player from feeling uncomfortable.

During the specific play state, the number of available balls increases remarkably. Thus, most players would wish to finish the game play ultimately at the end of the specific play state. However, it is cumbersome for a player to manipulate end button 24, 240 aiming at a right timing immediately after the end of the specific play state. On the other hand, it is unimaginable that a player finishes the game play during the specific play state.

As such, the game machine 1 is configured, when end button 24 or 240 is manipulated at an arbitrary timing during the specific play state, to make the ball shooting stop exactly at the end of the specific play state. Thus, the game can be finished at an ideal timing, with no need of the player's effort to perform the stop manipulation at the right timing of the end of the specific play state.

Figure 3:
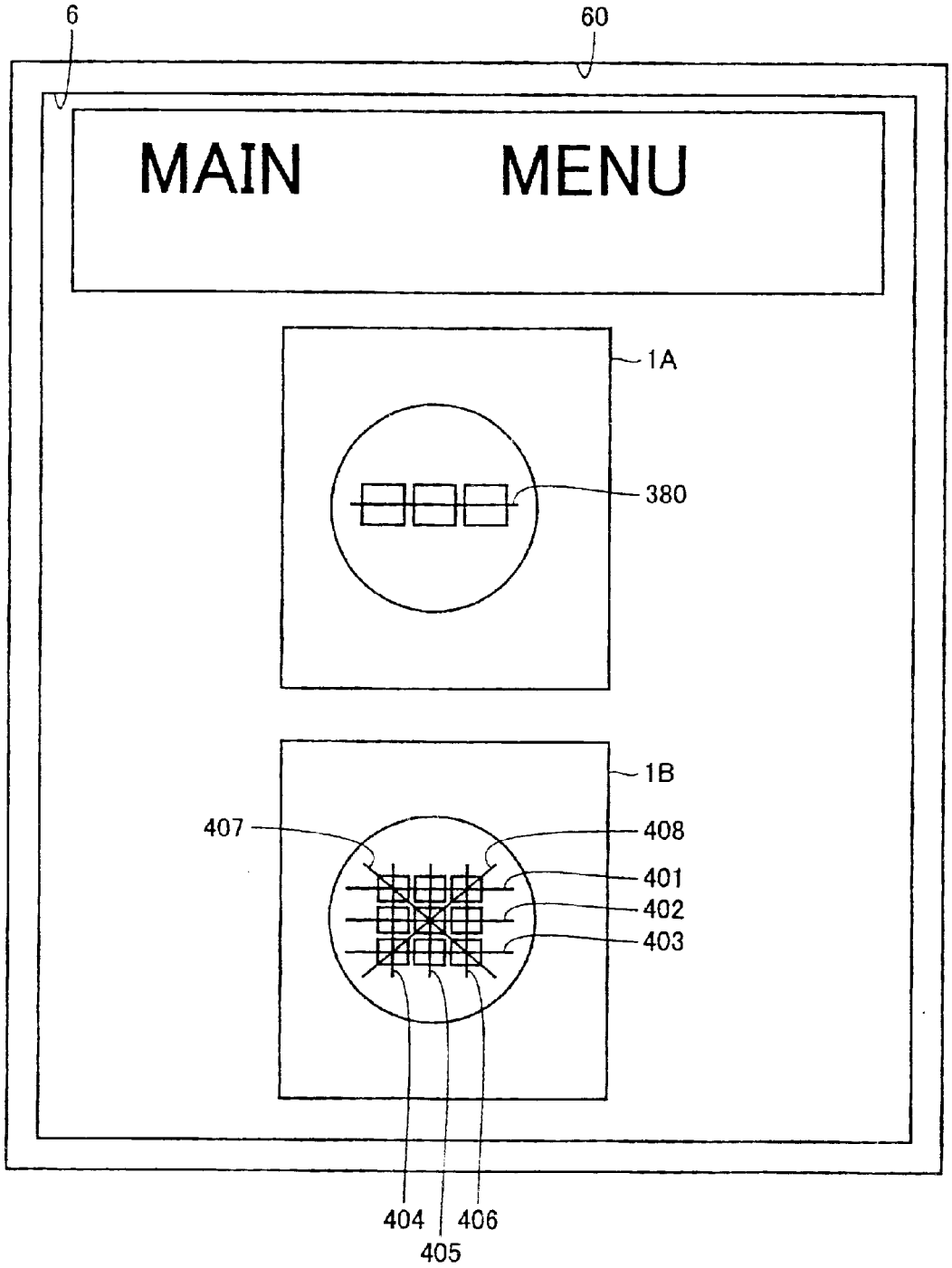
FIG. 3 shows a main menu displayed on the image display region.

FIG. 3 shows a main menu displayed in image display region 6. This main menu is displayed when menu button 212 (see FIG. 2) is pressed or game machine 1 is reset.

The main menu has different kinds of play board screens 1A, 1B displayed thereon. When a player touches one of the play board screens 1A, 1B on touch screen 60 with the finger, the selected play board screen appears in the image display region 6.

For example, FIG. 2 shows play board screen 1A having reels 38A, 38B, 38C in which certain figures are displayed in a variable manner and a hit line 380 (see FIG. 3) formed thereon. In play board screen 1B, whose enlarged view is not shown, reels (variable display units) displaying figures in a variable manner are arranged in a matrix of three rows and three columns, and eight lines (hit lines 401–408) in total are formed thereon in horizontal, vertical and diagonal directions.

The player is allowed to switch the display on image display region 6 to the main menu as necessary to select a game machine of a desired type. Although the play board screens 1A and 1B in this example are both of the Pachinko game machine, a play board screen of a slot machine may be included in the selectable screens. Instead of two kinds of screens as in this example, three or more kinds of play board screens may be prepared for selection therefrom. The selectable Pachinko game machines may include: the Pachinko game machine known as the "first kind" having variable display units (reels) as its main feature; the Pachinko game machine known as the "second kind" having an airplane type variable ball-receiving unit provided at the center of the play field; and an arrange ball type game machine.

Figure 4:
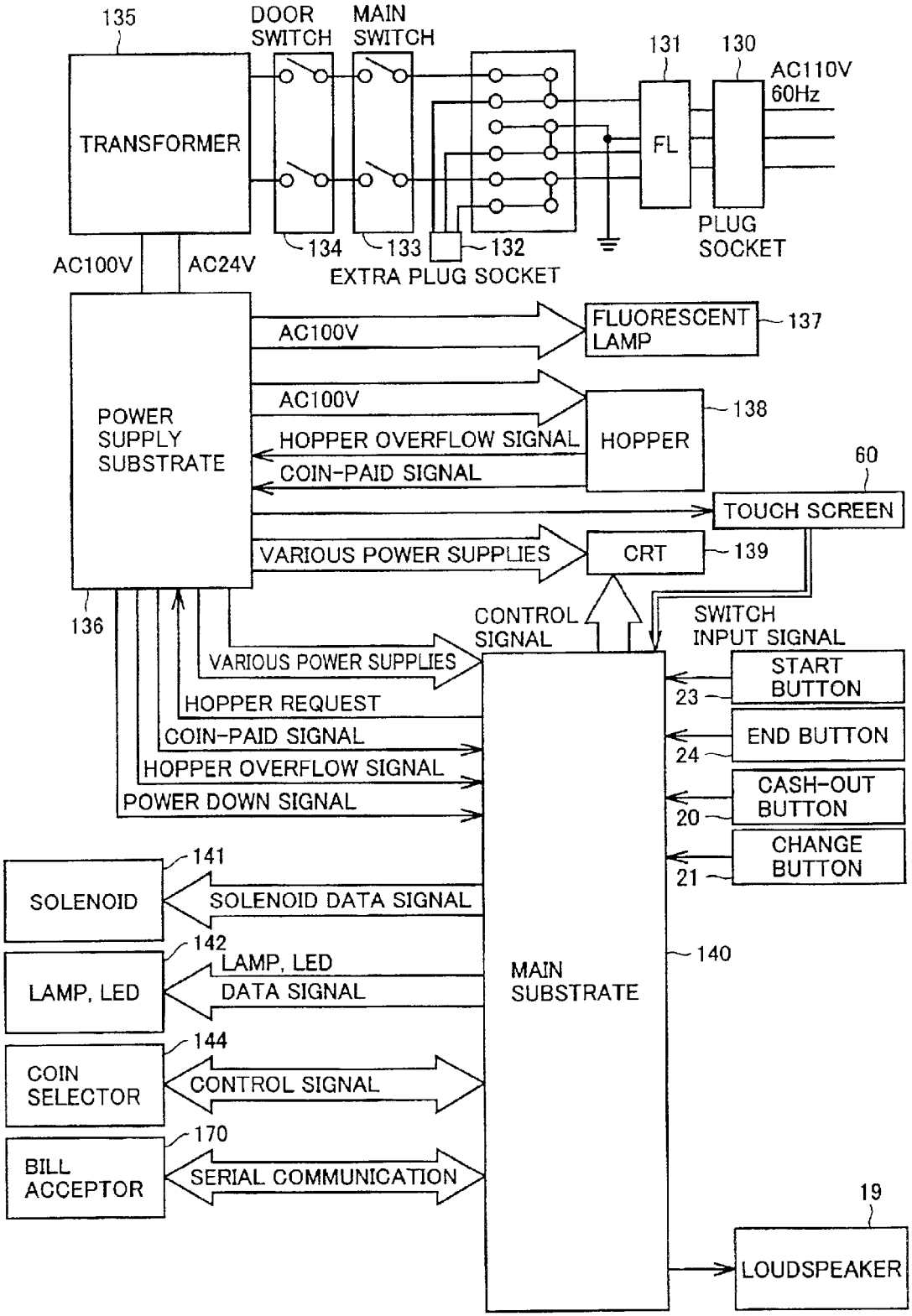
FIGS. 4 and 5 are block diagrams showing control circuitry used in the game machine.
Figure 5:
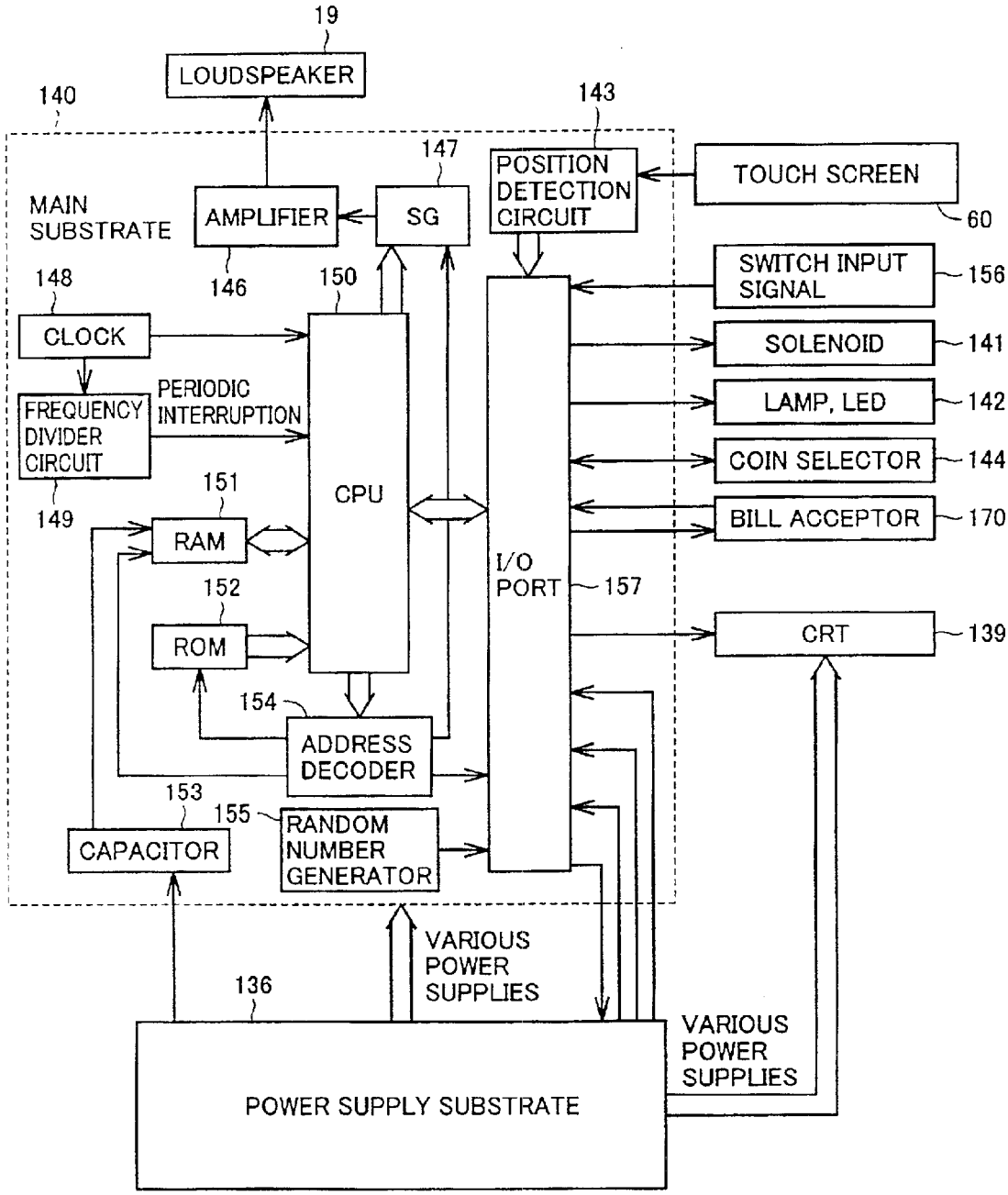

FIGS. 4 and 5 are block diagrams illustrating control circuitry used in game machine 1.

Game machine 1 is provided with a main substrate 140 for control of the game play in accordance with programs controlling various kinds of components, and a power supply substrate 136.

Power supply substrate 136 provides power to main substrate 140, hopper 138, touch screen 60, CRT display device 139, and a fluorescent lamp 137 used for illumination of game machine 1.

Touch screen 60 has a uniform electric field generated by voltages applied to respective corners thereof. Touching the surface of the screen 60 with a finger causes generation of a position detecting signal proportional to the distances from the respective corners. The position detecting signal generated is applied to main substrate 140. Main substrate 140 includes a position detection circuit 143 (see FIG. 5) that computes the position of the finger on the screen based on the received position detecting signal.

Main substrate 140 outputs a hopper request signal to power supply substrate 136. In receipt of the hopper request signal from main substrate 140, power supply substrate 136 controls hopper 138 to pay out the coins. After the payout of the coins, power supply substrate 136 transmits a coin-paid signal output from hopper 138 to main substrate 140. When coins are overflowing in hopper 138, power supply substrate 136 receives a hopper overflow signal from hopper 138 and sends the signal to main substrate 140. Upon lowering of the output power supplied from power supply substrate 136 to main substrate 140, power supply substrate 136 sends a power down signal to main substrate 140.

Power supply substrate 136 is supplied with power of AC 100V and AC 24V converted from power of AC 100V, 60 Hz via a plug socket 130, an FL 131, a main switch 133, a door switch 134, and a transformer 135. Reference number 132 designates an extra plug socket.

Main substrate 140 receives switch input signals from cash-out button 20, change button 21, start button 23 and end button 24, in response to manipulations of the buttons.

Main substrate 140 sends control signals for carrying out various image displays to CRT 139. A solenoid 141 is provided in the coin sorter. In response to solenoid 141 being excited according to a solenoid data signal from main substrate 140, a coin inserted via coin inlet 18 is sorted. Main substrate 140 carries out bidirectional communications with coin selector 144 and bill acceptor 170 that identifies paper notes inserted via bill inlet 17.

As shown in FIG. 5, main substrate 140 has a CPU 150 for control of the game play according to the programs controlling the various components. CPU 150 is connected to: a frequency divider circuit 149 which outputs an interrupt signal to CPU 150 periodically at a predetermined timing (2 ms, for example); a clock circuit 148 which supplies clock to frequency divider circuit 149 and CPU 150; and an address decoder 154 which decodes an address signal received from CPU 150 and outputs a signal for selecting any of a ROM 152, a RAM 151, an I/O port 157, a sound generator (SG) 147 and the like.

CPU 150 is further connected via I/O port 157 to a random number generator 155, solenoid 141, lamp, LED 142, coin selector 144, bill acceptor 170, position detection circuit 143, and CRT 139.

CPU 150 determines whether any of cash-out button 200, change button 210, reset button 222, start button 230 and end button 240 was manipulated, based on the signal input from position detection circuit 143.

CPU 150 further determines, based on the signal from position detection circuit 143, whether the player performed a manipulation to designate a winning hole on which he/she wants the balls to converge.

Sound generator (SG) 147 is connected to an amplifier 146. The output amplified by amplifier 146 is provided in an audible manner via loudspeaker 19.

The switch input signal 156 includes input signals from above-described cash-out button 20, change button 21, start button 23, end button 24 and the like. Power supply substrate 136 additionally provides power to a capacitor 153 which functions as a backup power supply for RAM 151.

Thus, data stored in RAM 151 is protected even in the case where the power supply from power supply substrate 136 to main substrate 140 is cut off due to main switch 133 turning off, or in the event of power failure. RAM 151 stores various administration data including information of various counters used for control of the game play and balance information of the game machine. ROM 152 stores various programs for the play control.

Since the data in RAM 151 is protected at the power failure, it is possible, upon recovery of the power, to recreate the game state immediately before the power failure to resume the game. For example, even if power supply is cut off in the state where a ball is about to enter a winning hole, the exact state can be recreated when the power is recovered.

CPU 150 carries out control operations of the game machine according to a program stored in ROM 152. More specifically, CPU 150 executes the program from the beginning to the end before entering a reset standby state. It re-executes the program from the beginning upon receipt of an interrupt signal from frequency divider circuit 149. CPU 150 controls the play state of the game machine by repeating the program from the beginning to the end at every input of an interrupt signal.

When some error occurs during the game, CPU 150 switches the display on image display region 6 to an error screen, for example. This error screen includes an image of, e.g., a running attendant, together with an error cause and an error code displayed on predetermined positions in the region 6. The error may occur when the hopper is empty, a coin is jammed, or excessive coins are discharged (surplus coin-paid).

Random number generator 155 generates different kinds of random numbers used for the play control. They include a random number for deciding whether to let a ball enter a winning hole or not, a random number for deciding the route of a ball in play field 7, and a random number for deciding display results of the reels before they come to a halt. The random numbers generated by random number generator 155 are taken into CPU 150 at predetermined timings. CPU 150 uses these random numbers to decide, prior to shooting of a ball, the route of the ball and whether the ball is to enter a winning hole, and decide, upon occurrence of a spin starter win, the display results of reels 38A, 38B and 38C.

Figure 6:
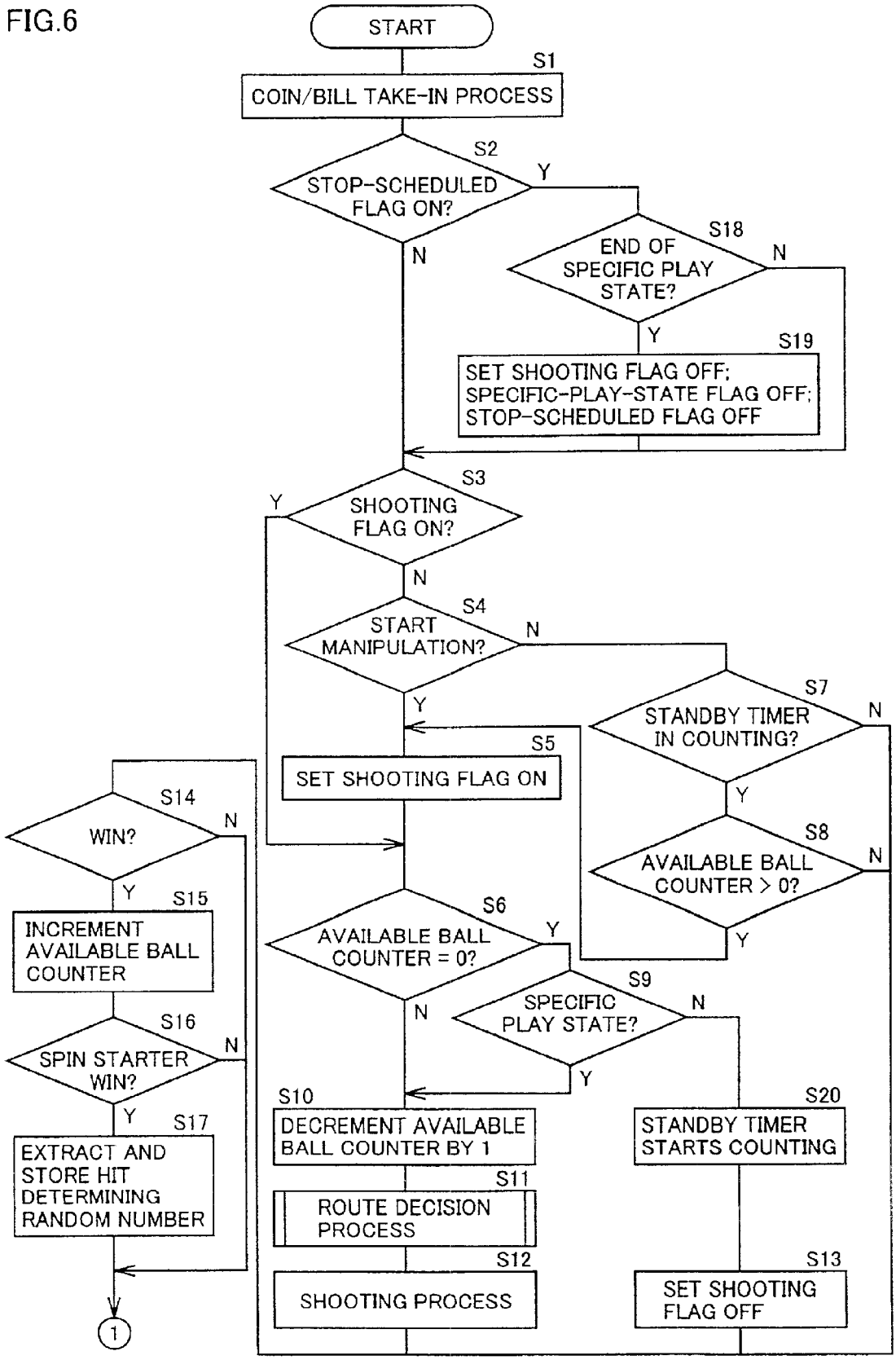
FIGS. 6 and 7 show a flow chart illustrating primary contents of game play control.
Figure 7:
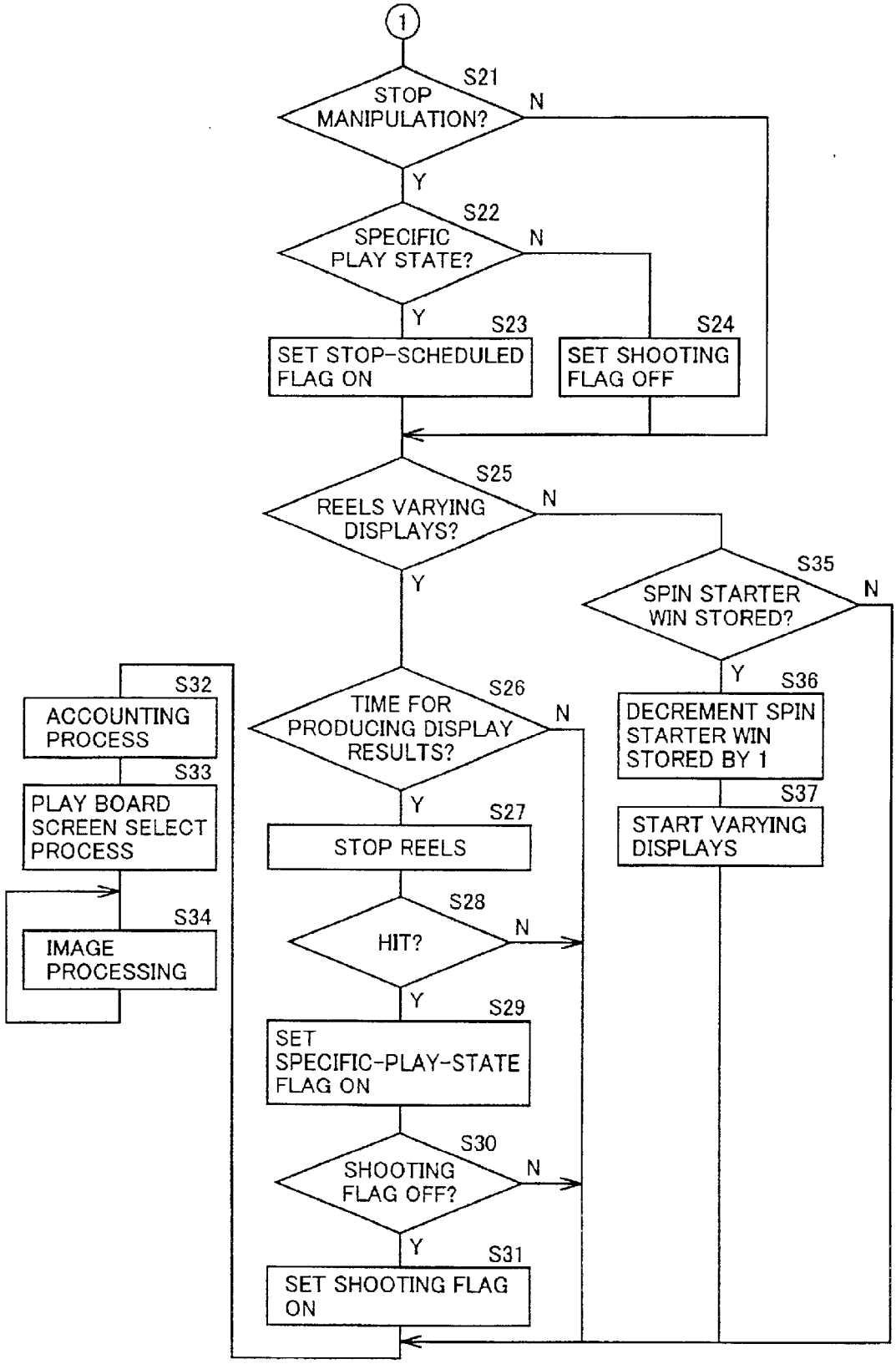

The contents of the game play control will now be described with reference to a flow chart. The flow chart shown in FIGS. 6 and 7 illustrates primary contents of the game play control carried out by CPU 150.

Firstly, a coin/bill take-in process is carried out (S1). When a player inserts a coin or bill, the number of balls corresponding to the coin or bill inserted is added to the value of an available ball counter. The available ball counter stores the number of available balls, and the counter value is displayed on BALL REMAINING display portion 216. The value displayed on BALL REMAINING display portion 216 is updated as the available ball counter is updated.

Next, determination is made whether a stop-scheduled flag is on (S2), which will be described later in detail. If the flag is not on, determination is made whether a shooting flag is on (S3). The shooting flag is set on when a ball is being shot. This shooting flag is set on in steps S5 and S31, as will be described later.

If the shooting flag is not on (NO in S3), determination is made whether a start manipulation was detected (S4). The start manipulation is detected, e.g., when start button 23, 230 was manipulated. If the start manipulation was detected, the shooting flag is set on (S5). This satisfies the first condition for shooting a ball.

Following S5, determination is made whether the value of the available ball counter is 0 or not (S6). If the value is not 0, the second condition for shooting a ball is satisfied. Control for ball shooting is started when the first and second conditions are both satisfied. Specifically, after decrement (by 1) of the available ball counter (S10), a route decision process is carried out to decide the route of a ball (S 1), and a process of shooting the ball based on the decided route is carried out (S 12). The route decision process (S 11) is a process of deciding the route along which a ball travels in the play field after deciding whether the relevant ball is to enter a winning hole. This route decision process will be described later in detail.

Next, determination is made whether a ball entered a winning hole (S14). If not, process goes to S21 which will be described later. If the ball entered a winning hole, the value of the available ball counter is incremented by a number predetermined for the relevant winning hole (S15). In the present embodiment, the value of the available ball counter is incremented by 1 in response to an entry of a ball into Spin Pocket 30A. It is incremented by 10 for an entry into big winning hole 30B and by 3 for an entry into any of normal winning holes 30C–30F.

Following the incrementing process in S15, determination is made whether the winning hole was Spin Pocket 30A, or, whether a spin starter win occurred (S 16). If it was not the spin starter win, process goes to S21. In the case of the spin starter win, a hit determining random number R3 is extracted and stored in a prescribed, spin starter win storage region (S17). This spin starter win storage region is provided in RAM 151.

Next, determination is made whether a stop manipulation was detected (S21). The stop manipulation is detected, e.g., when end button 24, 240 was manipulated. If the stop manipulation was detected, determination is made whether the game is in the specific play state (S22). If not, the shooting flag is set off (S24). Thus, next time a process is carried out based on this flow chart, it is determined in S3 that the shooting flag is not set on, so that the ball shooting is stopped.

If the game is in the specific play state at the time when the stop manipulation was detected (YES in S22), the stop-scheduled flag is set on (S23), without setting the shooting flag off. Therefore, the ball shooting is continued during the specific play state despite the detection of the stop manipulation. In this case, next time a process is carried out based on this flow chart, it is determined in S2 that the stop-scheduled flag is set on. Thus, provided that the specific play state is finished by that moment (S18), a specific-play-state flag indicating that the game is in the specific play state and the shooting flag are both set off (S19). That is, in the case where the stop manipulation is detected during the specific play state, the ball shooting is not stopped immediately, but stopped after the end of the specific play state. The stop-scheduled flag is also set off in S19.

Accordingly, a player who wants to finish the game at the end of the specific play state only needs to perform the stop manipulation at an arbitrary timing during the specific play state, instead of aiming at the right timing at the end of the relevant state. In other words, the above-described process allows the player to perform a reservation manipulation for finishing the game at the end of the specific play state.

When the stop-scheduled flag is set on in S23, notification that the ball shooting is to be stopped at the end of the specific play state is provided from loudspeaker 19 in an audible manner, for the player to confirm that the stop manipulation was detected validly. This precludes a possibility that a player who believes that he/she performed a stop manipulation—in reality, the manipulation was invalid and undetected—is confused to find that the ball shooting does not stop at the end of the specific play state. It also prevents a player having performed a stop manipulation from wondering why the ball shooting is not stopped immediately.

Next, determination is made whether displays on the reels are varying at the moment (S25). If not, determination is made whether there is any spin starter win stored (S35). If YES, following decrement (by 1) of the spin starter win (S36), the reels are made to start varying displays (S37). The display results of the reels thus started scrolling are predetermined in accordance with a value of hit determining random number R3.

If it is determined in S25 that the displays on the reels are varying, determination is made whether it is time to produce the display results on the reels (S26). If not, process goes to S32 which will be described later. If it is time to produce the display results, a process of stopping the varying displays on the reels is carried out (S27). Thereafter, determination is made whether the display results show a specific, "hit" combination (S28). If not, process goes to S32. If they show the "hit" combination, the specific-play-state flag is set on indicating that the game has attained the specific play state (S29). Determination is then made whether the shooting flag has been set off (S30). If YES, the shooting flag is forcibly set on (S31).

Accordingly, at the occurrence of the hit, the above-described first condition for shooting a ball is satisfied automatically, even if the shooting operation is being suspended at the moment, without waiting for detection of the start manipulation (S4). For example, assume that the reels having started varying displays after the player's stop manipulation based on a stored spin starter win come to a halt and show the display results of "hit" combination, and correspondingly big winning hole 30B starts to open. In such a case, the ball shooting is started automatically, eliminating the need for the player to hastily perform the start manipulation.

There also is a possibility that the value of the available ball counter happens to be 0 at the occurrence of the hit, or the player has run out of balls just after attaining the specific play state. In such a case, the player would need to hastily insert coins to obtain balls. However, he/she may be unfortunately out of cash at the moment.

In consideration of such situations, the present embodiment is configured, when the specific play state is attained by occurrence of the hit, to lend balls in advance to allow the player to enjoy the game play in the specific play state even if the second condition for the ball shooting is unsatisfied with the value of the available ball counter being 0 (S6).

More specifically, even in the case where the value of the available ball counter is 0, meaning that the second condition for the ball shooting is not satisfied (S6), it is determined YES in S9 if the specific play state has been attained as a result of the occurrence of the hit, so that control proceeds to the ball shooting process. In this case, the value of the available ball counter is updated to a negative value in S10. The balls lent in advance to the player are collected when the value of the available ball counter is incremented according to winning of ball(s).

If it is determined YES in S9 and control proceeds to S10, notification is made via loudspeaker 19 that the ball shooting is started with the available ball count being expressed in a negative value. During the ball shooting, the value displayed on BALL REMAINING display portion 216 is updated from 0 to −1, −2, −3 . . . every time a ball is flipped. The value is incremented to a positive direction in accordance with occurrence of the ball win(s). This prevents the player from wondering why the balls are shot even though there are no balls available. The color of display of the negative values may be differentiated from that of the positive values to draw the player's attention.

If a player wants to enjoy a game involving continuous ball shooting over a plurality of number of times, it would be bothersome for the player to perform the start manipulation each time. Thus, the present embodiment is configured such that, when a game is finished with the value of the available ball counter becoming 0 and supplement of balls is required to start another game, the next game is started automatically, without a start manipulation, if a coin or bill is inserted within a predetermined standby time period (of, e.g., 10 seconds) from the finish of the game.

More specifically, when the counter value of the available ball counter becomes 0 (YES in S6), provided that the game is not in the specific play state, a standby timer starts counting (S20). The shooting flag is set off temporarily (S13), and the game is finished temporarily. The standby timer counts down the aforementioned standby time period. For example, the value of this timer is displayed in image display region 6 like 10, 9, 8, . . . 1, 0. When the player inserts a coin or bill within a predetermined period of time after the standby timer starts counting, the value of the available ball counter is updated (incremented) by the coin/bill take-in process in S1. In this case, it is determined in S7 that the standby timer is doing the counting operation, and is determined in S8 that the value of the available ball counter has changed from 0 to a positive value. Thus, control proceeds to S5, even if a start manipulation is undetected, and the shooting flag is set on.

Accordingly, when a game is finished, the next game can be started only by inserting a coin (or bill) within a certain period of time, without a need of a start manipulation. This improves convenience of the player.

An accounting process in S32 is now described. The accounting process is for paying out coins to the player based on a value of the available ball counter when manipulation of cash-out button 20, 200 was detected. More specifically, upon detection of the manipulation of cash-out button 20, 200, the process of decrementing the value of the available ball counter by 1 while discharging one coin is repeated until the value of the available ball counter reaches 0.

A play board screen select process in S33 is for displaying, in response to a select manipulation by a player of a play board screen on the menu screen (see FIG. 3), the selected play board screen on image display region 6. In this play board screen select process, changing the play board screen is allowed only when ball shooting is being stopped.

After the process in S33, image processing is carried out repeatedly for control of the display on image display region 6 (S34). The flow shown in the flow chart of FIGS. 6 and 7 is repeated upon receipt of every interrupt signal periodically input from frequency divider circuit 149.

Figure 8:
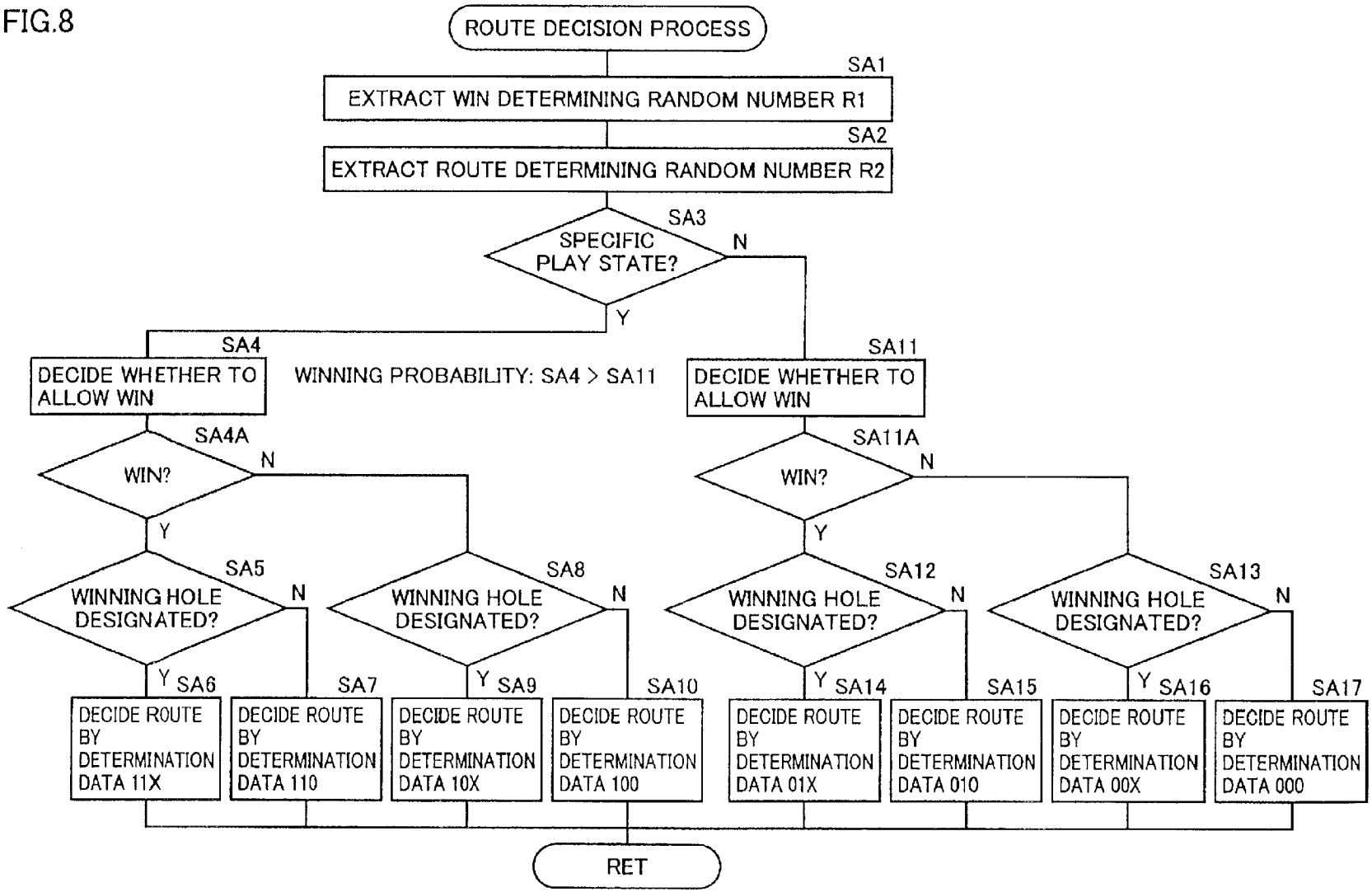
FIG. 8 is a flow chart illustrating a route decision process.

FIG. 8 is a flow chart illustrating the route decision process that is carried out in S11 in FIG. 6. FIG. 9 shows a route table in which various route data for determination of the route of a ball travelling through play field 7 are set in a table form.

In the route decision process, prior to flipping of a ball, decision is made whether the relevant ball is to become a winning ball (SA4, SA11). The route of the ball is also decided (SA6, SA7, SA9, SA10, SA14–SA17). Whether to make the flipped ball win or not is decided using a winning determining random number R1 extracted at a prescribed timing (SA1). The route of the ball is decided using a route determining random number R2 extracted at a prescribed timing (SA2). For example, winning determining random number R1 takes an arbitrary value in a range from 1 to 500. Route determining random number R2 takes an arbitrary value in a range from 1 to 100. The route table shown in FIG. 9 includes various determination data showing correlation between route determining random number R2 and the route data. In the route decision process, the determination data are used for determination of the route determining random number R2 to decide the route.

The routes of the balls can be classified, e.g., into winning routes following any of which a ball enters a winning hole, and losing routes following any of which a ball does not enter a winning hole before reaching the lost ball port. Further, the winning routes can be classified into those for respective winning holes 30A–30F. The losing routes can also be classified into those passing by respective winning holes 30A–30F, and those passing by none of the winning holes. The route table includes different kinds of routes for balls prepared in consideration of the foregoing.

In the route table shown in FIG. 9, "ROUTE X" shows the route name. "WINNING HOLE" shows a winning hole A–F toward which the route is directed. For example, "A" means winning hole 30A, and "B" represents winning hole 30B. "WIN" shows whether a win occurs or not. "O" means that a win occurs. "x" means that a win does not occur.

For example, "ROUTE A0" is a losing route following which a ball passes by winning hole 30A and reaches the lost ball port. "ROUTE A1" is a winning route following which a ball enters winning hole 30A.

Likewise, "ROUTE B0" is a losing route following which a ball passes by winning hole 30B and reaches the lost ball port. "ROUTE B1" is a winning route following which a ball enters winning hole 30B. That is, two kinds of route data for win and loss, respectively, are prepared for respective winning holes. In addition, a plurality of losing routes (e.g., routes G0, G1, G2, . . . ) are prepared following each of which a ball moves to the lost ball port without passing by any of the winning holes. Three or more kinds of different route data may be set for respective winning holes.

As described above, the determination data include data showing correlation between route determining random number R2 and the route data, used for determination of route determining random number R2.

There are various determination data provided. Here, the three-digit data of "000", "001", represent characteristics of the respective determination data. As shown in FIG. 9, the first digit shows whether the game is in the specific play state or in the normal play state other than the specific play state at the time of determination. The second digit shows whether it is decided to make a ball win or lose at the time of determination. The third digit shows whether the player has designated a winning hole at the time of determination, and if so, the winning hole designated by the player.

In the route decision process, one of these various determination data corresponding to a play state at the time of determination is selected for determination of the ball route.

For example, determination data "00A" is selected in the case where the game is not in the specific play state (first digit=0), the ball is decided not to enter a winning hole (second digit=0), and the player has designated winning hole 30A (third digit=A) at the time of determination.

Determination data "01A" is selected if the game is not in the specific play state first digit=0), the ball is decided to enter a winning hole (second digit=1), and the player has designated winning hole 30A (third digit=A) at the time of determination.

As shown in FIG. 9, with determination data "01A", a large number of values (1 to 80 among 1 to 100 in this case) of route determining random number R2 are allocated to the "route A1" that is a winning route leading to winning hole 30A. Thus, the probability that a ball takes the route to enter winning hole 30A designated by the player is high. However, small numbers of values of route determining random number R2 are allocated respectively to other winning routes (e.g., routes C1, D1) leading to winning hole 30C or other winning holes. This produces a possibility that a ball may enter a winning hole other than the one designated by the player. It is noted that there is no value of the random number allocated to "route B1" leading to big winning hole 30B, so as not to let the ball enter the big winning hole 30B during the state other than the specific play state. Further, no value of route determining random number R2 is allocated to a losing route, to prevent the losing route from being selected despite the decision having been made to let the ball enter a winning hole.

By comparison, with determination data of "00A", values from 1 to 80 of route determining random number R2 are allocated to the "route A0" that is a losing route passing by winning hole 30A and leading to the lost ball port. Thus, there is a high possibility that the ball passes by winning hole 30A designated by the player. However, small numbers of values of route determining random number R2 are allocated respectively to the routes that pass by winning hole 30B or other winning holes (e.g., routes B0, C0) and to the routes that do not pass by any winning holes (e.g., routes G1, G2). This causes some cases where a ball travels in a direction irrelevant to the winning hole designated by the player. It is noted that no value of route determining random number R2 is allocated to a winning route leading to entry of a ball into a winning hole. Thus, a winning route is prevented from being selected when the ball has been decided to lose.

Although not shown in the drawing, with determination data "10" corresponding to the case of "the specific play state, determined to win, and no designation of a winning hole", compared to determination data "010" corresponding to the case of "the normal play state, determined to win, and no designation of a winning hole", a larger number of random number values are allocated to the "route B1" leading to entry of a ball into big winning hole 30B. Thus, the probability that the big winning hole 30B is selected as the winning hole for a ball to enter is higher in the specific play state than in the normal play state.

Likewise, with determination data "100" corresponding to the case of "the specific play state, determined to lose, and no designation of a winning hole", compared to determination data "000" corresponding to the case of "the normal play state, determined to lose, and no designation of a winning hole", a larger number of random number values are set for the "route B0" to let a ball pass by big winning hole 30B. Accordingly, the probability that the ball passes by big winning hole 30B is higher in the specific play state than in the normal play state.

Thus, in the specific play state, balls are deflected towards big winning hole 30B to converge thereon. In addition, in the specific play state, when the player has designated the big winning hole 30B, the balls are made to further converge on the hole 30B. Alternatively, it may be configured to make determination data "110" and "010" have the same contents on the table and determination data "000" and "100" have the same contents on the table, such that the balls are made not to converge on big winning hole 30B unless the hole is designated by the player.

The contents of the route decision process will now be described with reference to the flow chart. Firstly, winning determining random number R1 is extracted (SA1), followed by extraction of route determining random number R2 (SA2). Determination is then made whether the current play state is the specific play state (SA3).

If it is the specific play state, decision as to whether to let a flipped ball enter a winning hole is made in SA4. If it is not the specific play state, the same decision is made in SA11. In either step of SA4 and SA11, whether to let the ball achieve a win is decided based on the winning determining random number R1 extracted in SA1. It is noted that the probability that a ball is decided to win in SA4 is set higher than the probability that a ball is decided to win in SA11. Thus, the ball shot in the specific play state is more likely to enter a winning hole than the ball shot in the normal play state. Such a setting is made to increase the actual winning probability of a ball in the specific play state than in the normal play state, in accordance with the apparently increased chance of winning as the big winning hole 30B is widely open during the specific play state. As described above, the routes of the balls in the specific play state are set to increase the winning probability particularly into the big winning hole 30B.

After the decision on winning or losing of the ball in SA4, the decided result is determined in SA4A. If it is decided to let the ball win, determination as to whether a winning hole has been designated is made in SA5. If it is decided to let the ball lose, the same determination is made in SA8. Here, "designation of a winning hole" refers to an act of the player to touch the image of the hole via touch screen 60 to designate the winning hole on which the balls are to be converged.

If it is determined in SA5 that a winning hole has been designated, route determining random number R2 is determined using determination data "11X" corresponding to the designated winning hole, to select a route of the ball from the route table (SA6). Here, "X" represents any of A–F of winning holes 30A–30F corresponding to the designated winning hole. Accordingly, the route of the ball is decided based on the determination data corresponding to the play conditions of "the specific play state, determined to win, with a winning hole designated".

Likewise, if it is determined in SA5 that a winning hole has not been designated, route determining random number R2 is determined with determination data "110", and a route of the ball is selected from the route table (SA7). Thus, the route of the ball is decided based on the determination data corresponding to the play conditions of "the specific play state, determined to win, with no winning hole designated".

The operations in SA8–SA10 being performed when it is determined that a ball is decided not to enter a winning hole are fundamentally the same as those in SA5–SA7. The determination data corresponding to the play conditions is selected, and the route of the ball is decided based on the selected determination data.

More specifically, if it is determined in SA8 that a winning hole has been designated, the route of the ball is decided based on the determination data "10X" corresponding to the play conditions of "the specific play state, determined to lose, with a winning hole designated". If it is determined in SA8 that a winning hole has not been designated, the route of the ball is decided based on the determination data "100" corresponding to the play conditions of "the specific play state, determined to lose, with no winning hole designated".

Further, in the case where it is determined in SA3 that the present state is not the specific play state, the determination data corresponding to the play conditions is selected and a route of the ball is decided based on the selected determination data, basically in the same procedure as in SA4–SA10.

More specifically, if it is determined that a ball is decided to achieve a win in SA11A and that a winning hole has been designated in SA12, then the route of the ball is decided based on determination data "01X" corresponding to the play conditions of "the normal play state, determined to win, with a winning hole designated". If it is determined that a ball is to enter a winning hole in SA11A and that a winning hole has not been designated in SA12, the route of the ball is decided based on determination data "010" corresponding to the play conditions of "the normal play state, determined to win, without a designation of a winning hole". If it is determined that a ball is decided not to win in SA11A and that a winning hole has been designated in SA13, the route of the ball is decided based on determination data "00X" corresponding to the play conditions of "the normal play state, determined to lose, with a winning hole designated". If it is determined that a ball is decided to lose in SA11A and that a winning hole has not been designated in SA13, then the route of the ball is decided based on determination data "000" corresponding to the play conditions of "the normal play state, determined to lose, without a designation of a winning hole".

Figure 10:
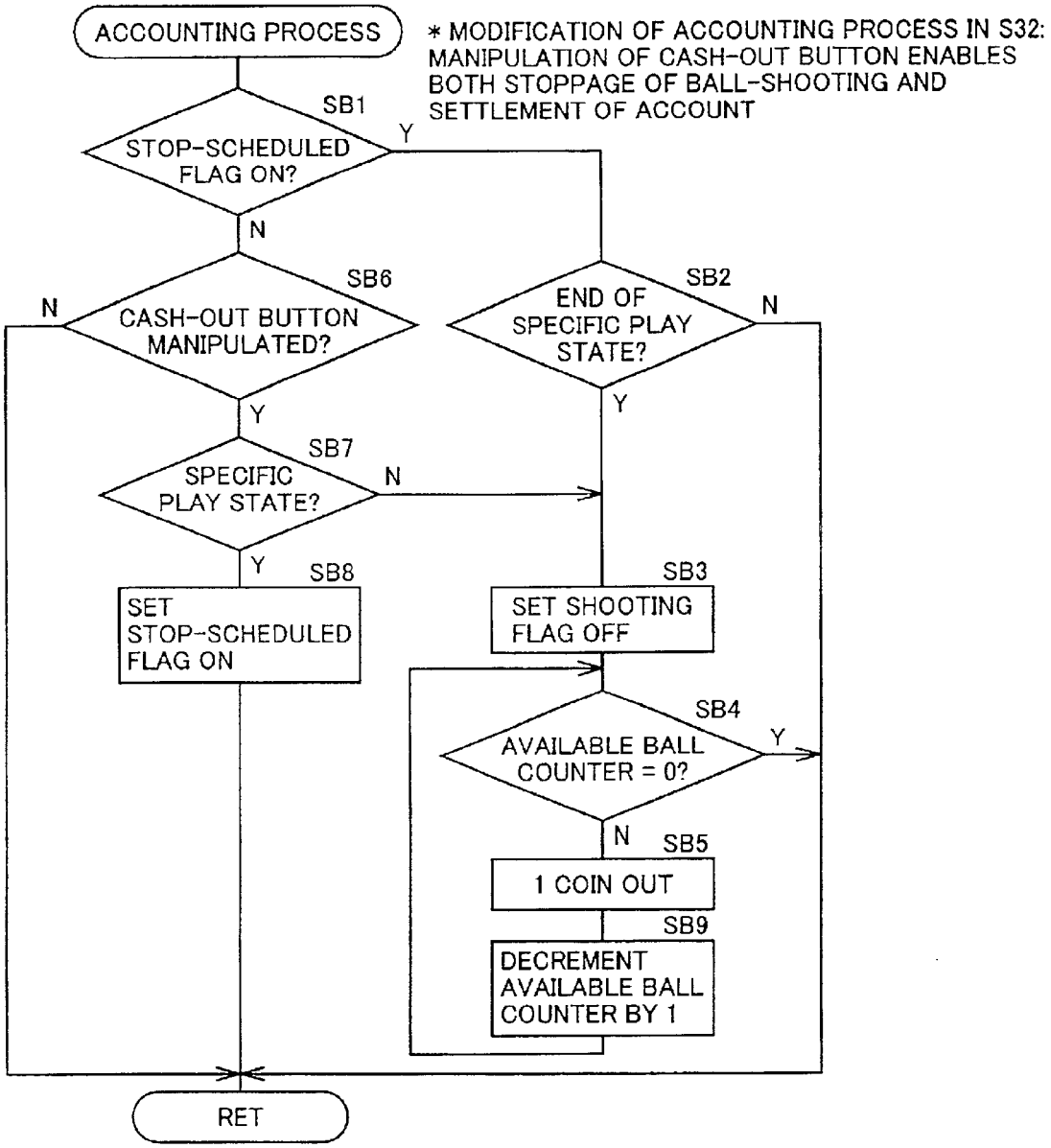
FIG. 10 is a flow chart illustrating a modification of the accounting process.

A modification of the accounting process will now be described with reference to FIG. 10. The flow chart in FIG. 10 shows the modification of the accounting process described with reference to S32 in FIG. 7. In this modified process, the manipulation of cash-out button 200 enables both the stopping of the ball shooting and the subsequent settling of the account. This process eliminates the step of manipulating end button 240 to finish the game.

In the flow chart shown in FIG. 10, the shooting flag is set off (SB3) upon detection of manipulation of the cash-out button in SB6, provided that the game is not in the specific play state (SB7). The process of paying out coins is then performed (SB4, SB5, SB9) until the value of the available ball counter reaches 0. In other words, the process to stop the ball shooting is effected in SB3, and subsequently, the accounting process is effected in SB4, SB5, SB9.

When the manipulation of the cash-out button is detected during the specific play state, the stop-scheduled flag is set on (SB8), without effecting the accounting process of SB4, SB5, SB9 immediately. Steps SB4, SB5, SB9 are performed after completion of the specific play state (SB1, SB2).

Second Embodiment

The second embodiment of the present invention will now be described with reference to FIGS. 11–13. Here, a modification of image display type game machine 1 described as the first embodiment above will be explained.

Figure 11:
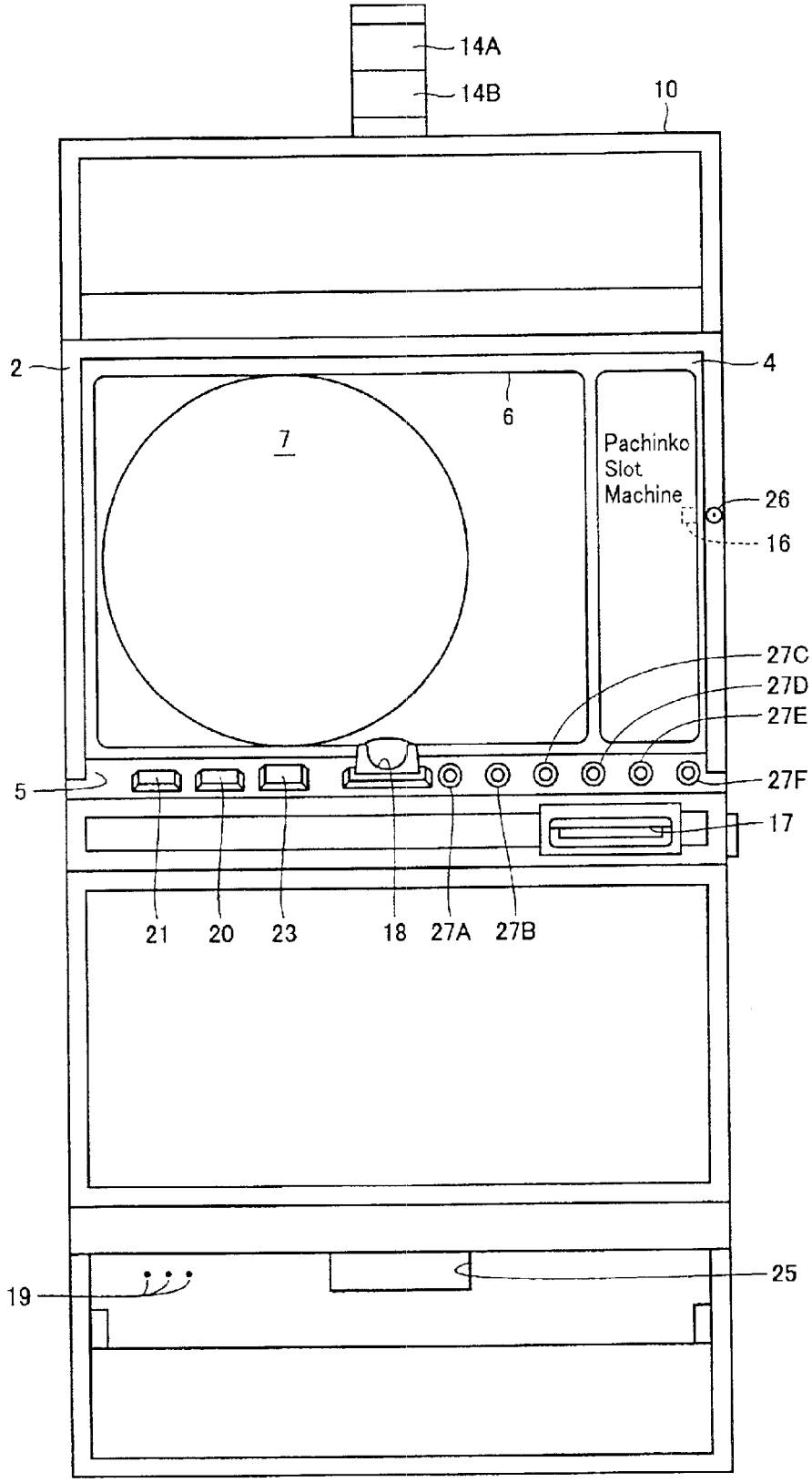
FIG. 11 is an entire front view of the game machine.

The entire front view of the game machine 10 according to the second embodiment is shown in FIG. 11, in which the same components as in the game machine 1 shown in FIG. 1 are denoted by the same reference characters, and description thereof will not be repeated here.

Figure 12:
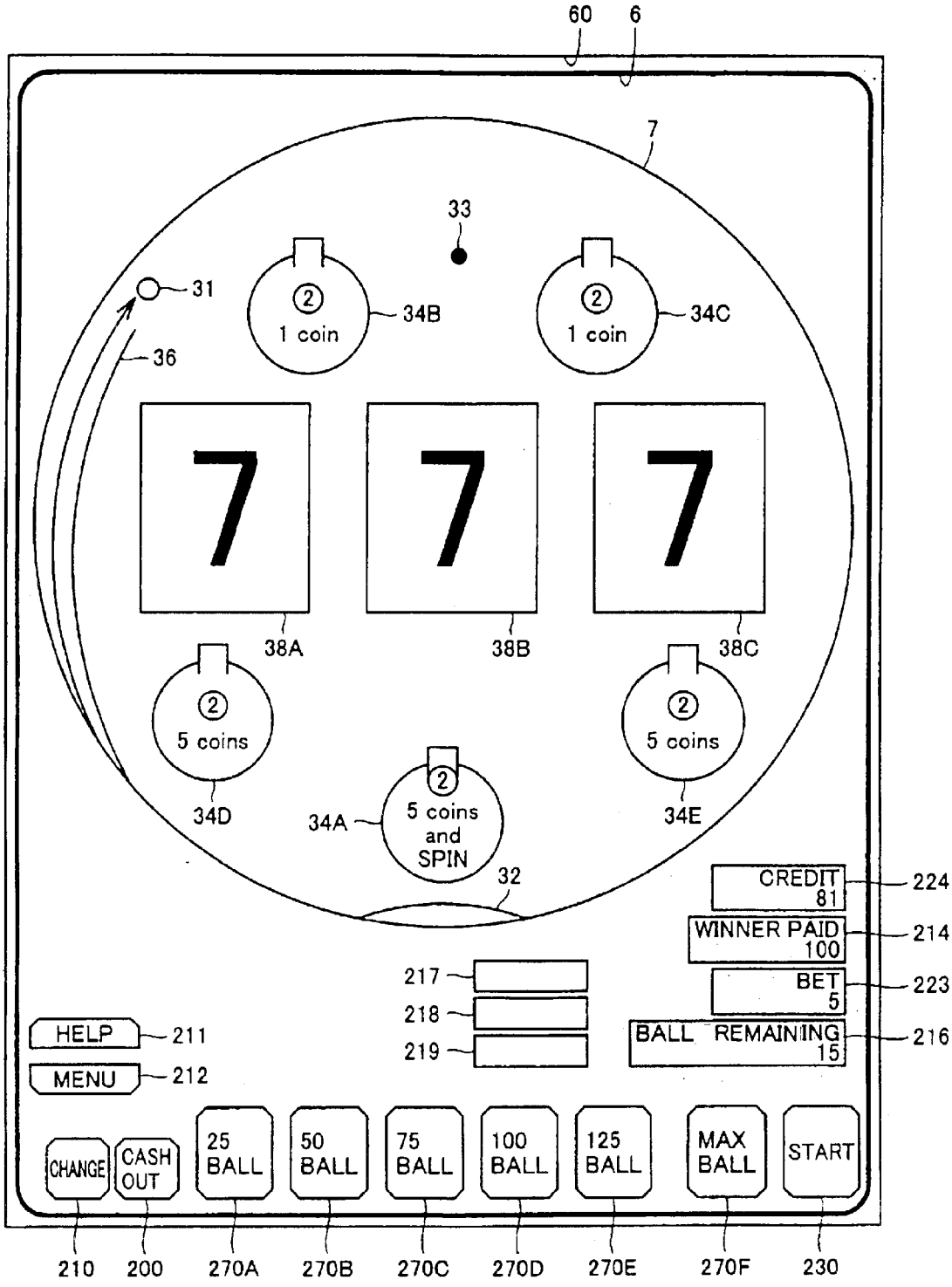
FIGS. 12 and 13 are enlarged views of the image display regions.

The game machine 10 of the second embodiment is identical to game machine 1 of the first embodiment shown in FIG. 1 in that it is provided with touch screen 60 covering image display region 6 (see FIG. 12). A player is allowed to manipulate touch screen 60 to call the menu screen as shown in FIG. 3 and to select one of various play board screens as desired. FIGS. 12 and 13 show by way of example two play board screens selectable by the player.

Game machine 10 of the second embodiment differs from game machine 1 of the first embodiment in that ball shooting is stopped automatically when a predetermined number of balls have been shot. Thus, game machine 10 of the present embodiment is not provided with end button 240 as in game machine 1 of the first embodiment. A plurality of select buttons 27A–27F are provided in game machine 10. These select buttons have different functions corresponding to the play board screen selected (see FIGS. 12 and 13). Therefore, the play board screens shown in FIGS. 12 and 13 will now be described in order.

Firstly, the play board screen shown in FIG. 12 will be described by comparison with that shown in FIG. 2. A plurality of winning holes, reels 38A–38C and others are provided in play field 7 in FIG. 12, as in FIG. 2. However, unlike the play field 7 in FIG. 2, play field 7 in FIG. 12 does not include a big winning hole having movable fragments.

As the display portions, a CREDIT display portion 224 and a BET display portion 223 are provided in addition to WINNER PAID display portion 214, BALL REMAINING display portion 216 and others. A credit count owned by a player is displayed on CREDIT display portion 224. A bet count is displayed on BET display portion 223. A credit count awarded to the player in one game is displayed on WINNER PAID display portion 214.

Further, as the manipulation portions, ball count select buttons 270A–270F are provided besides the start button 230 having the same function as start button 23 shown in FIG. 11. These ball count select buttons 270A–270F are for selecting a ball count, or a total number of balls to be used in one game. As shown in FIG. 12, each of ball count select buttons 270A–270E has an indication of ball count selectable therewith. For example, touching ball count select button 270A allows the ball count for one game to be set to 25, or 25 balls. Ball count select button 270F is a max ball button for selecting a maximum number of balls selectable within a range of the credit count owned by the player. However, even this max ball button 270F is touched, a ball count is not set exceeding the ball count of 125 that is an upper limit allowed to be used in one game. When the play board screen shown in FIG. 12 is displayed on image display region 6, select buttons 27A–27F mounted on front cover plate 5 of game machine 10 function in the same manner as these ball count select buttons 270A–270F, respectively.

The contents of the game will now be described. Although game machine 10 has two sets of operation buttons having the identical functions on front cover plate 5 and on image display region 6, the case where those displayed on image display region 6 are being manipulated will be described.

To start a game, the number of balls to be used in one game i.e., a "ball count", also referred to a "shooting count") is selected first. In this embodiment, the ball count can be selected in a range from 1 to 125. Of the ball counts in this range, 25 balls, 50 balls, 75 balls, 100 balls and 125 balls can be selected by manipulating the corresponding ball count select buttons 270A–270F.

For example, by touching ball count select button 270A, a process of withdrawing, from credits owned by the player, the credit count necessary to set the ball count of 25 is carried out. The credit count displayed on CREDIT display portion 224 is decremented correspondingly, and the credit count withdrawn is displayed on BET display portion 223. That is, the credit count withdrawn is displayed as the bet count. In this game, the credit count of "1" is decremented for one ball, for example. Thus, by manipulating ball count select button 270A, the value of "25" is displayed on BET display portion 223. In addition, the ball count is set in exchange of the credit count withdrawn, so that the value of "25" is displayed on BALL REMAINING display portion 216 as the number of available balls. This ball count displayed on BALL REMAINING display portion 216 is stored in an available ball counter implemented by a RAM (not shown) provided in the main substrate of game machine 10.

If the credit count owned by the player is less than the desired bet count, he/she inserts a paper note into the game machine. Upon insertion of the paper note, credits corresponding to the value of the note are given to the player, and the credit count displayed on CREDIT display portion 224 is updated. Upon insertion of a coin, the ball count displayed on BALL REMAINING display portion 216 is updated. This means that the player can insert coins to set a ball count other than those selectable by ball count select buttons 270A–270E. It is assumed that the ball count of "1" can be set with one coin in this game. Thus, in order to set the ball count shootable in one game to 27, for example, 27 coins can be inserted. Alternatively, for faster setting of the desired shooting count, ball count select button 270A can be manipulated to set the ball count of "25" and then two coins can be inserted additionally. As such, by combining the manipulation of ball count select buttons 270A–270F with insertion of the coins, it is possible to set the ball count other than those selectable with ball count select buttons 270A–270F at high speed on a per ball basis.

If the player wants to bet all the credits displayed on CREDIT display portion 224 in one game, he/she manipulates max ball button 270F. In response, the value having been displayed on CREDIT display portion 224 appears on BALL REMAINING display portion 216 without alternation, and the value on CREDIT display portion 224 is updated to "0". If the credit count owned by the player is greater than 125 as the max bet count, however, the value on BALL REMAINING display portion 216 is updated to "125", and the subtraction of 125 from the credit count before manipulation of max ball button 270F is displayed on CREDIT display portion 224.

A game is started upon manipulation of start button 230 following the setting of the ball count for one game, and balls 31 of the number having thus been set are sequentially flipped into play field 7. The numerical value on BALL REMAINING display portion 216 is decremented by 1 every time a ball is shot. The game machine may be provided with a shooting stop button with which ball shooting can be stopped at an arbitrary timing before all the balls having been set are shot. Provision of such a shooting stop button allows a player to confirm the display states of the respective display portions during the game without being pressed for time. Further, by manipulating this shooting stop button to suspend the ball shooting when there is at least one spin starter win stored, the player can enjoy the varying displays on reels 38A, 38B, 38C taking plenty of time. It may be configured such that ball shooting is suspended when start button 230 is manipulated while the balls are being shot, and the ball shooting is resumed when start button 230 is manipulated again.

If a flipped ball enters any of winning holes 34A–34E, coins of a number predetermined in response to the relevant winning hole are awarded to the player as the credits. For example, five coins are awarded for every entry into winning hole 34A, 34D or 34E, whereas one coin is awarded for every entry into winning hole 34B or 34C. When a win occurs, the credit count on WINNER PAID display portion 214 is incremented by the credit count predetermined for the relevant win. The number of times of ball entry into a winning hole occurred in one game is displayed in a round window of the relevant hole.

Of winning holes 30A–30E, when a win occurs in winning hole 34A that is a Spin Pocket, reels 38A, 38B, 38C start scrolling. If the win occurs during the time period in which scrolling of the reels cannot be started, e.g., in the middle of scrolling thereof, the spin starter win is temporarily stored. Once the reels 38A, 38B, 38C attain the state where they can start scrolling, reels 38A, 38B, 38C start scrolling based on the spin starter win stored. An upper limit (of, e.g., 4) may be set for the number of the spin starter wins allowed to be stored, to prevent storage of the spin starter wins by the number exceeding the upper limit.

A predetermined period of time after the start of scrolling, reels 38A, 38C and 38B come to a halt in this order. If the display results at the time of the halt show, e.g., "777" as in FIG. 12, there occurs a "reel win", according to which a predetermined number of coins are awarded to the player. At the occurrence of the reel win, the credit count on WINNER PAID display portion 214 is incremented by the credit count predetermined for the reel win. A reel win display portion may also be provided for displaying the number of times of reel wins (or, a reel win count) obtained by reels 38A, 38B, 38C in one game.

A game is finished when the predetermined number of balls are shot and scrolling of reels 38A, 38B, 38C is stopped. At the completion of the game, the credit count on CREDIT display portion 224 is incremented by the value displayed on WINNER PAID display portion 214. In accordance with the updating of the credit count on CREDIT display portion 224, the winning counts displayed in the round windows of the respective winning holes are all updated to "0", and the value displayed on WINNER PAID display portion 214 is also updated to "0".

The player who wants to finish the game ultimately can manipulate cash-out button 200 to settle the game result. In response to manipulation of cash-out button 200, the credit count displayed on CREDIT display portion 224 is decremented one by one until it reaches "0", while a coin is paid out one by one at every decrement of the credit count.

Although image display region 6 further includes manipulation portions 211, 212 and display portions 217–219 displayed thereon, they have the same functions as the portions in FIG. 2 denoted by the same reference characters, and therefore, description thereof will not be repeated here.

The play board screen shown in FIG. 13 will now be described by comparison with the screen in FIG. 12. Play field 7 is provided with a plurality of winning holes and reels, as in play field 7 shown in FIG. 12. The difference therebetween is that, instead of the three reels in FIG. 12, nine reels 40A–40I are arranged in a matrix of three rows and three columns in play field 7 in FIG. 13. These reels 40A–40I are provided with eight hit lines in total, three in the row direction, three in the column direction and two in the diagonal direction. A hit is achieved when a predetermined combination of figures (e.g., 777) is shown on any of the hit lines. The same applies to the reels provided in the play board screen 1B shown in FIG. 3.

In particular, in a game provided with reels 40A–40I, multiple kinds of hits are prepared for which different credit counts are to be awarded. For example, the credit count being awarded when odd numbers (e.g., 777) are aligned on a hit line may be set twice the credit count being awarded when even numbers (e.g., 888) are aligned on a hit line.

Figure 13:
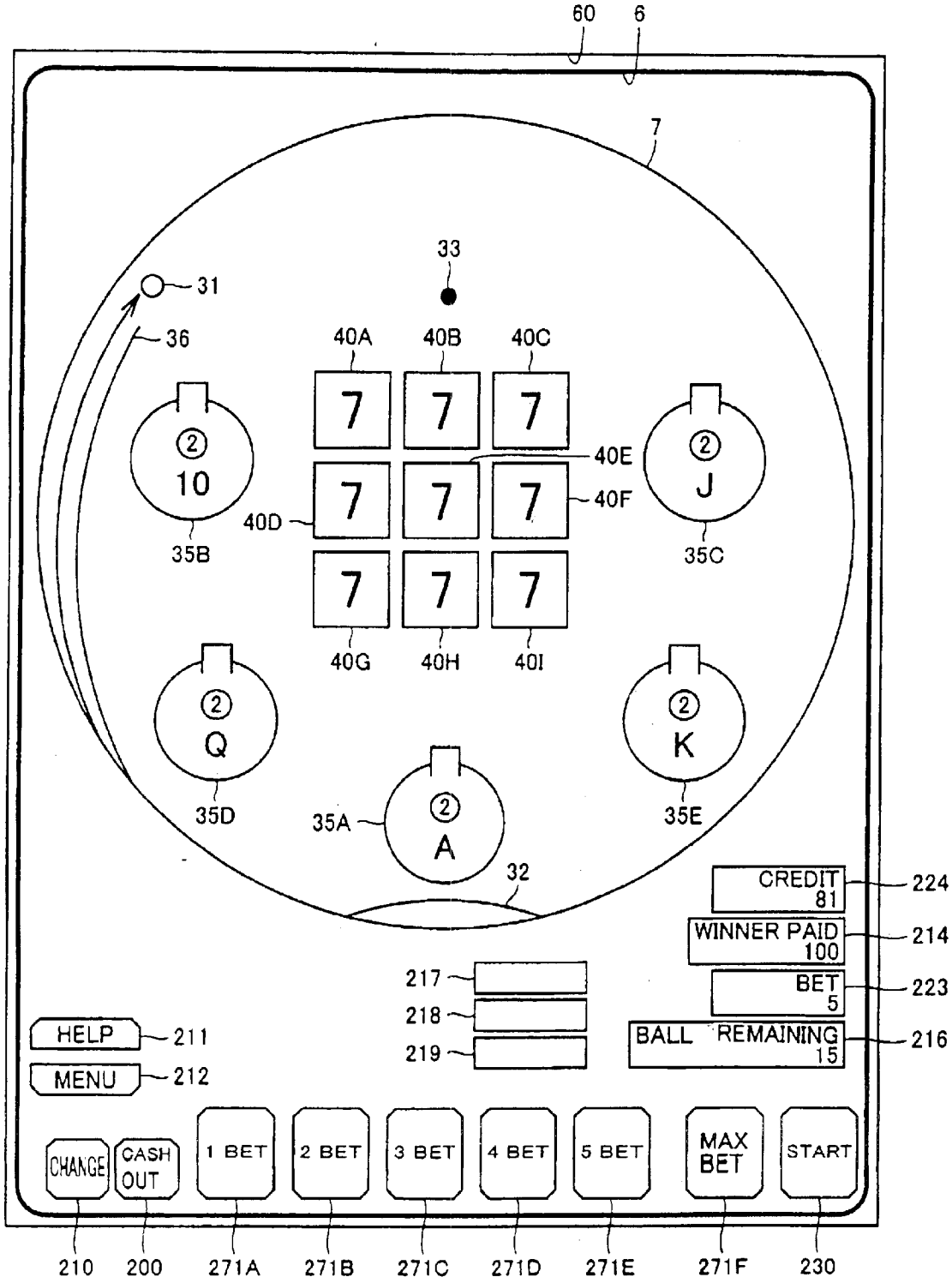

In play field 7 shown in FIG. 13, a winning hole serving as a Spin Pocket is not provided. Reels 40A–40I start scrolling upon manipulation of the start button 230 (23). Thus, reels 40A–40I produce display results only once a game.

WINNER PAID display portion 214, BALL REMAINING display portion 216, CREDIT display portion 224, BET display portion 223 and others are provided as the display portions, as in the play board screen shown in FIG. 12.

Bet count select buttons 271A–271F are provided as the manipulation portions, at the same positions as ball count select buttons 270A–270F in FIG. 12. These bet count select buttons 271A–271F are for selecting a bet count for one game. As shown in FIG. 13, bet counts selectable are displayed on respective bet count select buttons 271A–271E. For example, by touching bet count select button 271A, the bet count for one game is set to "1". Bet count select button 271F is a max bet button for selecting a bet count of a maximum number selectable within a range of the credits owned by the player. However, even if max bet button 271F is touched, the bet count exceeding the upper limit of "5" is not set for one game. While the play board screen shown in FIG. 13 is being displayed on image display region 6, the select buttons 27A–27F mounted on front cover plate 5 of game machine 10 function as bet count select buttons 271A–271F, respectively.

The contents of the game will now be described. Although game machine 10 have two sets of operation buttons having the same functions on front cover plate 5 and image display region 6, the case where the buttons displayed on image display region 6 are being manipulated will be described in the following.

In this game, the ball count for one game is predetermined to a constant number (of, e.g., 15) irrelevant to the bet count. The number of hit lines on reels 40A–40I is also unvaried with respect to the bet count.

To start the game, the bet count for one game is selected first. The bet count can be selected in a range from 1 to 5, for example, by manipulating relevant bet count select button 271A–271F.

For example, by touching bet count select button 271A, a process of withdrawing one credit from the credits owned by the player is carried out, and the credit count displayed on CREDIT display portion 224 is decremented by 1 correspondingly. The credit count of "1" thus withdrawn is displayed as a bet count on BET display portion 223. Upon setting of the bet count, a shooting count of "15" predetermined irrelevant to the bet count is displayed on BALL REMAINING display portion 216.

If the credit count owned by the player is less than the desired bet count, the player inserts a paper note into the game machine. When the paper note is inserted, credits corresponding to the value of the note are given to the player, and the credit count displayed on CREDIT display portion 224 is updated. When coins are inserted, the bet count on BET display portion 223 is incremented by 1 for each coin. However, when a coin is inserted at the time when the bet count is already "5" as the upper limit, the credit count displayed on CREDIT display portion 224 is incremented by 1.

When start button 230 is manipulated after the setting of the bet count, 15 balls 31 as predetermined are sequentially flipped into play field 7, and reels 40A–40I start scrolling. The numerical value on BALL REMAINING display portion 216 is decremented by 1 for each ball shot. The game machine may be provided with a shooting stop button with which ball shooting can be stopped at an arbitrary timing before all the balls as set are shot. Alternatively, it may be configured such that ball shooting is suspended upon manipulation of start button 230 while the balls are being shot, and the ball shooting is resumed upon manipulation of start button 230 again.

If a flipped ball enters any of winning holes 35A–35E, the number of times of wins shown in the round window of the relevant winning hole is incremented. As shown in FIG. 13, the alphanumeric figures (10, A, J, K, Q) constituting "royal flush" in the poker game are assigned to the respective winning holes. Upon completion of the game with a predetermined number of (e.g., 15) balls being all flipped, if the alphanumeric figures of the winning holes into which the balls have entered during the game show a combination constituting any of predetermined, multiple kinds of hands, a credit count corresponding to "bonus point(s) predetermined for the relevant hand" multiplied by the "bet count" is awarded to the player.

For example, if every one of the 15 balls has entered any of the winning holes, the winning count becomes 15. The player attains 15 cards from among "10", "A", "J", "K" and "Q", including duplicates, and gains the bonus points according to the hands determined by combinations of the cards obtained. Hands such as "single royal flush" with one set of "10, A, J, K and Q", "double royal flush" with two sets of "10, A, J, K and Q", "triple royal flush" with three sets of "10, A, J, K and Q", and others including 1 to 7 pairs may be set.

Reels 40A–40I having started scrolling in response to the start manipulation may produce the display results, e.g., at the final stage of the game. If the display results show any of multiple kinds of "hit" combinations predetermined, a credit count corresponding to "bonus point(s) predetermined for the relevant combination" multiplied by the "bet count" is awarded to the player.

In summary, the credit count awarded to the player during this game will be "(the bonus points in accordance with the hand(s) obtained by the alphanumeric figures of the winning holes into which balls have entered+the bonus points in accordance with the figure combination(s) of the reel win (s))×the bet count". When a game is finished, the credit count earned in the game is displayed on WINNER PAID display portion 214, and the credit count on CREDIT display portion 224 is incremented by the credit count thus earned.

When the player wants to finish the game ultimately, he/she can manipulate cash-out button 200 to settle the game result. The operation effected upon manipulation of cash-out button 200 is the same as described in connection with FIG. 12. Although image display region 6 further includes manipulation portions 211, 212 and display portions 217–219 displayed thereon, those have the same functions as the portions in FIG. 2 designated by the same reference characters, and thus, description thereof will not be repeated here.

As described above, game machine 10 of the second embodiment is provided with the "function to change the route of a flipped ball by manipulation of a player", as in game machine 1 of the first embodiment. Further, game machine 10 of the second embodiment is provided with main substrate 140, power supply substrate 136, hopper 138, touch screen 60, CRT display device 139 and others, as in the control circuitry shown in FIGS. 4 and 5. CPU 150 mounted on main substrate 140 performs various controls in accordance with detection signals input from select buttons 27A–27F or touch screen 60.

For example, in the case where a game machine of the type as shown in FIG. 12 has been selected, CPU 150 sets the ball shooting count per game in accordance with manipulation of select buttons 27A–27F or touch screen 60. In response to manipulation of start button 23 (230), it starts control such that balls of the number having been set are sequentially flipped into play field 7. When proper coins are inserted into coin inlet 18, CPU 150 increments the shooting count by 1 for each coin.

Third Embodiment

The third embodiment of the present invention will now be described with reference to FIGS. 14 and 15. In the first and second embodiments, the image display type game machine having the play field, balls, winning holes and others all displayed as images has been described. However, the present invention is also applicable to a game machine employing actual balls, as described hereinafter as the third embodiment.

Figure 14:
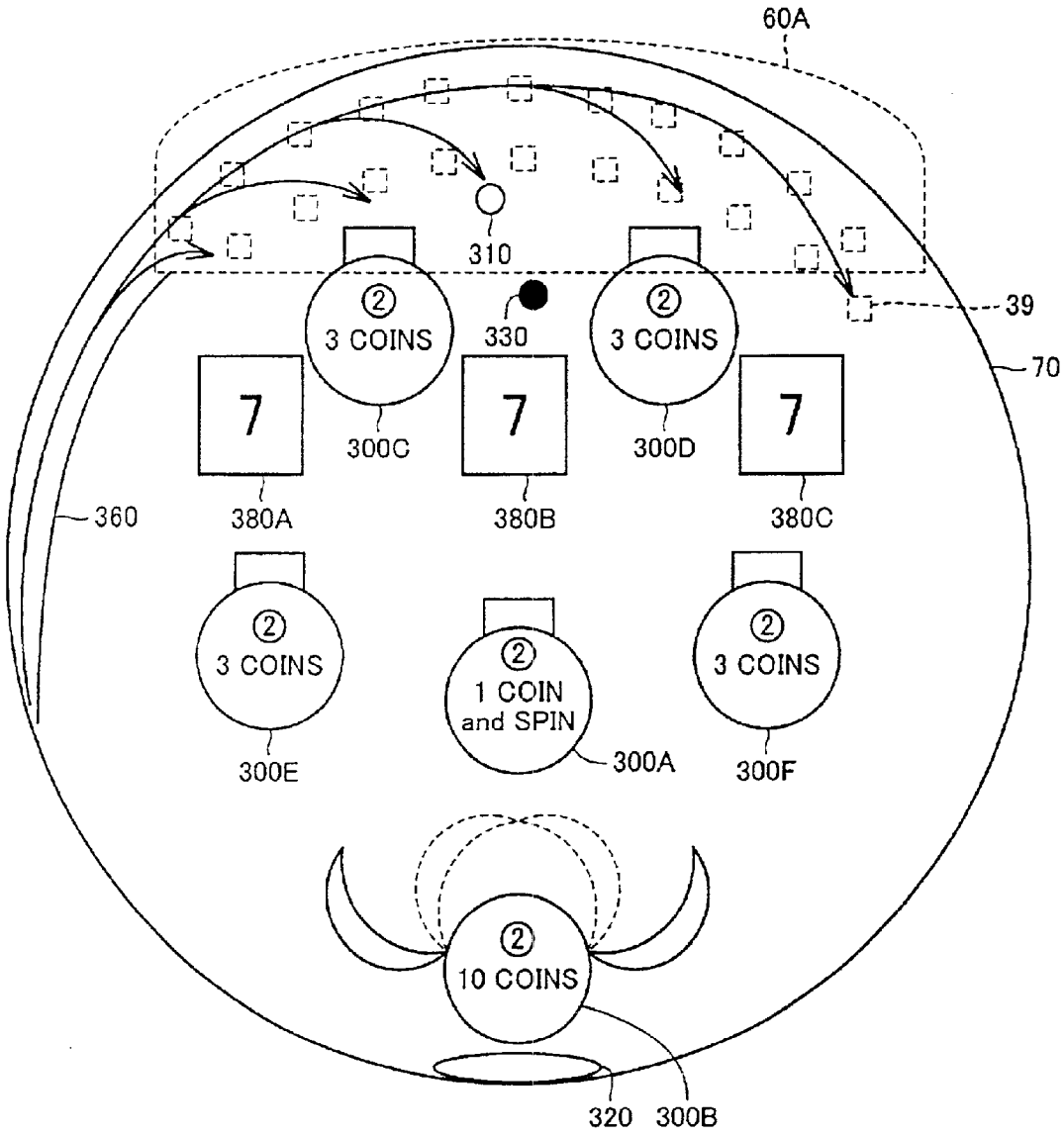
FIG. 14 is a front view of the play field.
Figure 15:
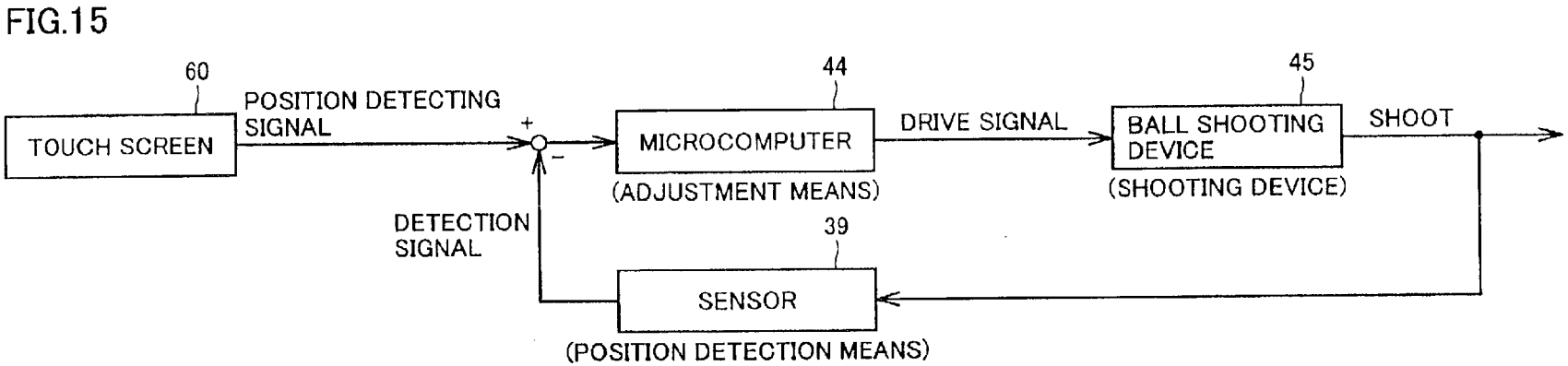
FIG. 15 is a block diagram illustrating how the shooting strength is adjusted by a microcomputer.

FIG. 14 is a front view of the play field 70 in the case where the present invention is applied to a game machine in which actual balls are flipped. This play field 70 is provided, e.g., on a play board installed in a frame of the game machine. Play field 70 includes a guide rail 360 for guiding a flipped ball 310 to the upper portion of play field 70, reels 380A, 380B, 380C, six winning holes 300A–300F, a lost ball port 320, a great number of obstructive nails 330 (of which one nail 330 is representatively shown), and others. Of the plurality of winning holes, winning hole 300A is a Spin Pocket, and winning hole 300B is a big (or variable) winning hole.

The game machine having such play field 70 is provided with various operation buttons as in game machine 1 shown in FIG. 1, for example. A glass plate and a touch screen are provided to cover the front face of play field 70. In response to manipulation of start button 23, a ball shooting device 45 (see FIG. 15) starts to shoot actual balls sequentially into play field 70 with a predetermined shooting strength. The ball shooting is stopped upon manipulation of end button 24.

The game is played in the same manner as in the image display type game machine described as the first embodiment. However, in the game machine of the third embodiment, a great number of sensors 39 are provided in play field 70 to make the routes of the flipped balls changed in accordance with manipulation of the player. These sensors 39 detect balls moving within play field 70. Magnetic sensors may be employed as the sensors 39. Alternatively, photo-sensors may be employed by making the corresponding portions of the play field transparent to receive the light.

The player roughly understands a relation between the shooting strength and the route of the flipped ball in the course of playing the game. A number of arrow-headed curved lines shown in FIG. 14 represent a variety of routes of the flipped balls. For example, with a pretty strong shooting strength, a ball moves far to the right side in the drawing following the curve of the periphery (or the outer rail) of play field 70 before separating from the rail. The ball then drops downward from the position as a dropping point. By comparison, with a slightly weaker shooting strength, a ball separates from the outer rail at the top of play field 70, and drops downward from the dropping point at the top. Since a great number of obstacle nails 330 are provided in play field 70 to irregularly change the routes of the flipped balls, it is impossible to identify, solely from the dropping point of a ball, the ultimate point (winning hole or lost ball port) the ball will reach. However, in the course of playing the game, it becomes guessable to some extent in consideration of the effects of obstacle nails 330.

In the case of the third embodiment, the manipulable region of the touch screen covering the play field 70 includes a region 60A corresponding to the upper area of play field 70 in the proximity of the outer rail. When a player touches an arbitrary position in the region 60A with the finger, the ball shooting strength is adjusted automatically to cause a ball to drop downward from the designated position.

The control for the automatic adjustment of the ball shooting strength will now be described with reference to FIG. 15. A microcomputer 44 as an example of the adjustment unit outputs a drive signal to ball shooting device 45 as an example of the shooting device for adjustment of the shooting strength of the device 45. Ball shooting device 45 has its motor controlled by the drive signal received from microcomputer 44, and shoots a ball at a shooting strength corresponding to the drive signal. Every time a ball is shot by ball shooting device 45, the flipped ball is detected by a plurality of sensors 39, and the detection signals are sent to microcomputer 44 within the game machine. Microcomputer 44 stores information of the mounted positions of the sensors 39, and makes an analysis of the route of each ball according to the detection signals from sensors 39. Normally, microcomputer 44 decides the dropping point of the ball automatically (or autonomously) without being affected by the player's manipulation of start button 23, and controls ball shooting device 45 to shoot a ball such that it reaches the relevant dropping point.

When the player designates a dropping point, a position detecting signal indicating the designated position is input via touch screen 60 to microcomputer 44 as the adjustment unit. Microcomputer 44 identifies the dropping point designated by the player based on the position detecting signal. It determines the position relation between the dropping point currently effective and the designated dropping point. If the designated dropping point is farther than the current dropping point, microcomputer 44 reduces the shooting strength of ball shooting device 45, while it increases the shooting strength if it is nearer. Thereafter, it repeats the adjusting process of the shooting strength by determining the difference between the current dropping point and the designated dropping point based on the detection signals received from sensors 39, to perform the feedback control.

The number of sensors 39 may further be increased for finer adjustment of the dropping point of the ball. Moreover, the sensors 39 may be provided over the entire surface of the play field 70 to allow adjustment of not only the ball-dropping point but also the point at which the ball ultimately arrives. In this case, it is also possible to allow a player to designate a winning hole on which the flipped balls are to converge, as in the first embodiment.

Although the game machine having the ball shooting strength adjusted by microcomputer 44 has been described in the third embodiment, the game machine may be configured to have a ball shooting strength fixed in advance with which balls are flipped automatically.

Features of Game Machine of the Invention

Figure 16:
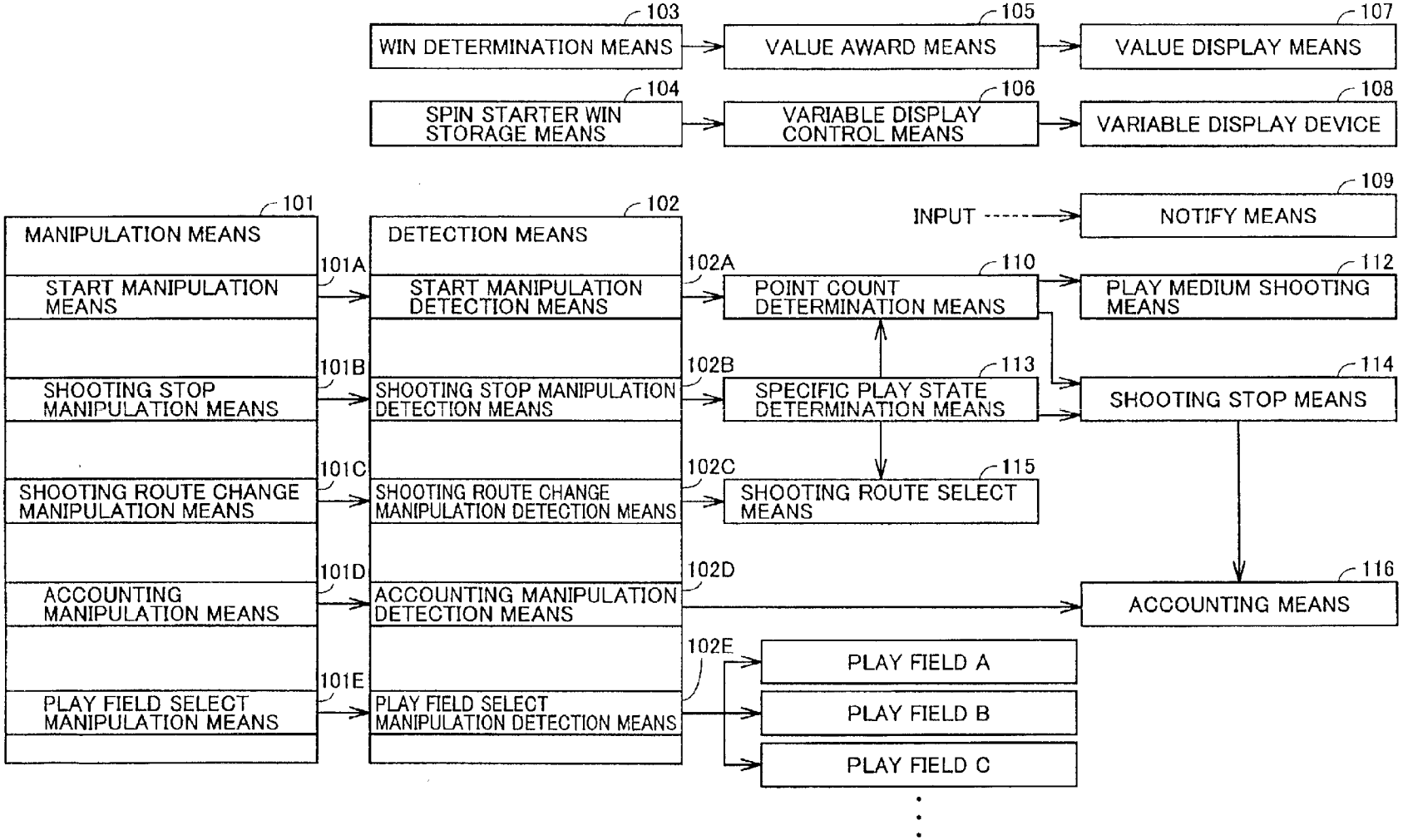
FIG. 16 is a block diagram schematically illustrating the features of the game machine.

FIG. 16 is a block diagram schematically illustrating distinctive features of the game machine according to the present invention. The game machine includes: an input unit 101; a detection unit 102 which detects an input via the input unit; a win determination unit 103 which determines occurrence of a win; a value award unit 105 which awards, when win determination unit 103 determines that a win occurred, a value (play value, play result value) of the amount in accordance with the winning manner; a value display unit 107 which displays the amount of the value owned by the player; a spin starter win storage unit 104 which stores spin starter win(s) of a number up to a predetermined upper limit; a variable display control unit 106 which controls a variable display device 108 to start varying display based on the spin starter win stored in spin starter win storage unit 104 and to produce a display result; a notify unit 109 which gives notification of prescribed information by sound or image; a point count determination unit 110 which determines the amount of points owned by the player and stored within the game machine; a play medium shooting unit 112 which shoots play media into a play field; a specific play state discrimination unit 113 which determines whether a play state is a specific play state; a shooting stop unit 114 which controls to stop shooting the play media; a shooting route selection unit 115 which preselects a shooting route of the play medium to be shot into the play field; and an accounting unit 116 which settles the account by paying out the points owned by the player as monetary objects like coins or by recording the points to a recording medium.

Input unit 101 includes: a start input unit 101A for a user to enter an input to start a game (to start shooting the play media); a shooting stop input unit 101B for the user to enter an input to stop shooting the play media; a shooting route change input unit 101C for the user to enter an input to change the shooting route of the play medium; an accounting input unit 101D for the user to enter an input to settle the account; and a play field selection input unit 101E for the user to enter an input to select one of multiple kinds of play fields.

Detection unit 102 includes: a start detection unit 102A which detects a manipulation of start input unit 101A; a shooting stop detection unit 102B which detects a manipulation of shooting stop input unit 101B; a shooting route change detection unit 102C which detects a manipulation of shooting route change input unit 101C; an accounting detection unit 102D which detects a manipulation of accounting input unit 101D; and a play field selection detection unit 102E which detects a manipulation of play field selection input unit 110E.

Point count determination unit 110 determines the points owned by the player in response to start detection unit 102A detecting the manipulation of start input unit 101A. As a result of the determination, if there is at least one point owned, it causes play medium shooting unit 112 to start shooting the play media. Referring to the discrimination result of specific play state discrimination unit 113, if the play state is the specific play state, it causes play medium shooting unit 112 to start shooting the play media even if the start manipulation has not been detected or even if there is no point owned. In the respective case, notify unit 109 makes notification that "the play media are shot even though the start manipulation was undetected, since the game is in the specific play state", or that "the play media are shot even though there is no point owned, since the game is in the specific play state".

Further, the point count determination unit determines the points owned during the game. It causes shooting stop unit 114 to stop shooting the play media when the point is run out, and starts counting a predetermined standby time. However, if variable display device 108 produces a specific display appearance as the display result based on a spin starter win stored in spin starter win storage unit 104, the game enters the specific play state. In this case, it causes play medium shooting unit 112 to start shooting the play media even if there is no point owned. If the value displayed on value display unit 107 is incremented within the predetermined standby time by insertion of a coin by the player, for example, it causes play medium shooting unit 112 to start shooting the play media even if the start manipulation is not detected by start detection unit 102A.

Specific play state discrimination unit 113, in response to shooting stop detection unit 102B detecting the manipulation of shooting stop input unit 101B, determines whether the play state is the specific play state. If not, it causes shooting stop unit 114 to immediately stop shooting the play media. If it is the specific play state, it causes shooting stop unit 114 to stop shooting the play media after the specific play state is finished. In this case, notify unit 109 makes notification that "the shooting of the play media is stopped after expiration of the specific play state".

Shooting stop unit 114 controls to stop shooting the play media, and at the same time, causes accounting unit 116 to settle the play result of the player (see FIG. 10).

Shooting route selection unit 115 refers to the discrimination result of specific play state discrimination unit 113 to confirm whether the play state is the specific play state. It differentiates the shooting routes according to whether the play state is the specific play state or not. Further, shooting route selection unit 115, in response to shooting route change detection unit 102C detecting the manipulation of shooting route change input unit 101C, reflects the detected condition to the process of selecting the shooting route.

Hereinafter, further distinctive features and modifications of the present invention will be enumerated.

1-1. A game machine of the present invention is provided with a casing (e.g., front frame 2) and a play field having a winning region (e.g., respective winning holes 30A–30F) into which a play medium (e.g., a ball) can enter to achieve a win, and includes:

a storage unit (e.g., an available ball counter) which stores the number of available play media for shooting into the play field;

a start detection unit (e.g., S4) which detects an input from a user (e.g., manipulation of start button 230) to start shooting the play media into the play field;

a shooting control unit (e.g., S6, S12, S13) for initiating shooting the play media into the play field in response to the start detection unit detecting the input from the user to start shooting the play media, and controlling to stop shooting the play media in response to all the available play media having been shot; and a stop detection unit (e.g., S21, SB6) which detects an input from the user to stop shooting the play media;

wherein the shooting control unit controls to stop shooting the play media in response to the stop detection unit detecting the input from the user to stop shooting the play media (e.g., S24, SB3).

According to the configuration described above, the shooting operation of the play media is started by the relevant input of the user. This eliminates the necessity of controlling shooting of every play medium, so that the player's labor required for the game can be reduced. Further, the shooting of the play media can be stopped according to the player's intention.

1-2The game machine further includes a display unit (e.g. BALL REMAINING display portion 216) which identifiably displays the number of available play media stored in the storage unit.

Such a configuration enables confirmation of the number of available play media for shooting.

1-3. The game machine further includes an accounting detection unit (e.g., SB6) which detects a manipulation for settling a play result, wherein the shooting control unit controls to stop shooting the play media in response to the accounting detection unit detecting the manipulation for settling the play result (e.g., SB3).

With such a configuration, the player does not need to enter the input to stop shooting the play media prior to the manipulation for settling the play result. This improves manipulability of the game machine.

1-4. The shooting control unit controls to resume shooting the play media if additional available play media are added within a predetermined period of time after the shooting of the play media is stopped in response to all the available play media having been shot (e.g., S7, S8).

With such a configuration, when the count of the play media stored in the storage unit is incremented before the predetermined period of time passes after the shooting of the play media is stopped due to running out of the play media, the shooting operation of the play media is restarted even if the user does not designate restart of shooting. As such, when performing a plurality of games continuously, the player does not need to repeat the shooting start manipulation for each game, so that the manipulability is improved.

1-5. The play field, the play medium and the winning region are displayed as images by an image display device (e.g., CRT display device 139) mounted to the game machine.

Such a configuration eliminates problems like a ball jam in a winning region, so that maintenance of the game machine is facilitated.

1-6. The game machine further includes a selection detection unit (e.g., S33) which detects the user's selection of a play field, wherein the image display device displays one of a predetermined number of different play fields in accordance with the selection detected by the selection detection unit (e.g., see FIG. 3).

With such a configuration, the player is allowed to select a desired one of the plurality of play fields. A single game machine can provide a plurality of games having different play fields.

1-7. The game machine further includes a first input unit (e.g., start button 230) for the user to enter the input to start shooting the play media, and a second input unit (e.g., end button 240) for the user to enter the input to stop shooting the play media, wherein the first input unit and the second input unit are configured with transparent electrode films (e.g., touch screen 60).

With such a configuration, the first input unit and the second input unit are formed with the transparent electrode films. Thus, start of the shooting and stop of the shooting each can be designated only by touching the film with a finger, so that the manipulability is improved.

1-8. The input unit provided in the game machine for manipulation thereof includes a cash-out button 20 (200), a change button 21 (210), a start button 23 (230), an end button 24 (240), and a reset button 220. Instead of such operation buttons, a mouse or a track ball may be employed to manipulate the game machine.

Start button 23 (230) constitutes a play start input unit with which a start manipulation of the game play can be performed and a shooting start input unit with which a manipulation for starting shooting the play media can be performed. End button 24 (240) constitutes a play end input unit with which an end manipulation of the game play can be performed and a shooting stop input unit with which a manipulation for stopping shooting the play media can be performed. A touch screen 60 is formed of a transparent electrode film, and constitutes a position detection unit which, when the player touches a prescribed position, detects the relevant position. In this game machine, the play field is covered by the position detection unit (i.e., covered by the transparent electrode film).

1-9. In the game machine shown in FIG. 2, all the available balls are shot unless end button 24 (240) is manipulated. Alternatively, the ball shooting may be stopped automatically once balls of a predetermined, unitary ball count (of, e.g., 20 balls) have been shot, even if there still are remaining balls. In this case, another set of balls of the unitary ball count may be emitted additionally when the start manipulation is performed after completion of the shooting of the first set of balls of the unitary ball count. Further, the ball shooting may be suspended by manipulation of end button 24 (240) during the shooting of the balls of the unitary ball count. In this case, the shooting control unit is configured to start control of shooting of the play media of a predetermined, unitary ball count sequentially into the play field in accordance with a predetermined shooting pattern, in response to a first input detection unit detecting an input from the user to start shooting the play media. The unitary ball count (the unitary count) may be made changeable by manipulation of the player. Further, a unitary ball count setting button for performing such manipulation may be provided in the game machine to allow the unitary ball count to be set when its manipulation is detected by the game machine. In this case, the unitary ball count setting button constitutes a unitary count setting input unit with which a manipulation for setting the unitary count can be performed. Still further, a setting detection unit detecting the manipulation for setting the unitary count is disclosed. The unitary ball count setting button may be implemented by touch screen 60.

1-10. The game machine may be made playable using a prepaid card. For example, a card processor for processing the prepaid card is connected to the game machine 1. When a prepaid card is inserted into the card processor, a predetermined amount is withdrawn from the balance on the card, and balls of the number corresponding to the withdrawn amount are afforded to the player. At the settlement of the account, instead of payout of the coins, information that can identify the number of available balls to the player may be recorded on a recording medium (e.g., a membership card) owned by the player.

1-11. CPU 150 constitutes a play control unit which controls the play state of the game machine. Reels 38A, 38B, 38C constitute variable display devices having their display states changeable. CPU 150 also constitutes a variable display control unit which controls production of display results of the variable display devices. When the display results of the variable display devices show a predetermined, specific display appearance (e.g., 777), the play state can be changed to a specific play state advantageous to the player. In this specific play state, big winning hole 30B repeatedly changes between an open state and a closed state for a predetermined period of time. However, the operating manner of big winning hole 30B during the specific play state is not limited thereto; it may maintain the open state through the specific play state. Big winning hole (or variable winning hole) 30B maintains a state inhibiting entry of a ball during the normal play state, whereas it changes between a state allowing entry of the ball and the state inhibiting entry of the ball during the specific play state. Alternatively, big winning hole (variable winning hole) 30B may be configured to change between a state where entry of the ball is allowed but difficult due to narrow clearance between a pair of movable fragments and a state where entry of the ball is easy.

1-12. Cash-out button 20 (200) constitutes an accounting input unit with which a manipulation for settling the play result can be performed. Alternatively, cash-out button 20 (200) may be configured such that manipulation thereof enables stopping of the ball shooting as well as subsequent accounting operation, as described in conjunction with FIG. 10. In this case, cash-out button 20 (200) constitutes the play end input unit with which an end manipulation of the game play can be performed and the shooting stop input unit with which a manipulation for stopping the shooting of the play media can be performed. The cash-out button serves as both the accounting input unit and the play end input unit (or the shooting stop input unit).

The graphic representations of the play board screens 1A, 1B shown in FIG. 3 each constitute a selection input unit with which a play field (or a kind of the game machine) can be selected.

1-13. A shooting suspension period may be provided in which ball shooting is suspended automatically for a predetermined period of time (e.g., 10 seconds) after expiration of the specific play state, even if balls are remaining. In this case, it may be configured such that the ball shooting is stopped completely when manipulation of the end button or the cash-out button is detected during this shooting suspension period, until the start manipulation is detected afterwards.

Provision of such a shooting suspension period allows the player who wants to ultimately finish the game play at the end of the specific play state to perform the end manipulation during this shooting suspension period without being pressed for time.

As such, the distinctive feature that "the shooting control unit controls to stop shooting the balls automatically upon expiration of the specific play state in which the variable winning region (e.g., big or variable winning hole 30B) attains a first state advantageous to the player", or that "the shooting control unit controls to stop shooting the balls automatically for a predetermined period of time after the expiration of the specific play state in which the variable winning region attains the first state" is disclosed.

1-14. The variable winning region (or variable ball-receiving unit) becomes changeable from a second state disadvantageous to the player to a first state advantageous to the player in accordance with the display results of the variable display devices (reels 38A, 38B, 38C). The variable display devices start varying displays based on a spin starter win stored. A spin starter win stored count display portion for displaying the count of the stored spin starter wins may further be provided in image display region 6 of the game machine.

There is a case where, after the specific play state is finished, the variable display devices are controlled to produce display results based on the play medium emitted into the play field before the end of the specific play state, and the display results thus produced show the above-described specific display appearance. In such a case, the shooting control unit controls to resume shooting the play media into the play field automatically, even if the first input detection unit does not detect the user input to start shooting the play media.

1-15. In the case where the player runs out of the ball during the specific play state, the ball shooting is continued with the value of the available ball counter updated to a negative value. Alternatively, the balls may be shot with the value of the available ball counter maintained at 0 and incremented when a win occurs. In this case, the balance of the player can be adjusted, once the value of the available ball counter outnumbers the balls having been shot, by subtracting the number of flipped balls from the value of the counter. Yet alternatively, upon runout of the ball during the specific play state, a prescribed value may be added to the available ball counter to let the ball shooting continue (the value should be sufficient enough to allow continuation of the game play during the specific play state in consideration of wins expected during the relevant state, for example). The prescribed value thus initially added to the available ball counter can be subtracted therefrom when the accounting manipulation is performed or upon expiration of the specific play state.

A certain amount of points (or available balls) may be awarded to the player as a privilege of the specific play state. In this case, it is desirable, from the standpoint of fair treatment, to award a predetermined, fixed amount of points to a player every time the specific play state is attained, regardless of whether the player owns balls or not at the moment.

1-16. When the stop-scheduled flag is set on in S23, notification that the ball shooting is stopped after the specific play state is finished is made by loudspeaker 19 in an audible manner. When it is determined YES in S9 and the process goes to S10, notification that the ball shooting is continued with the available ball count taking a negative value is made again by loudspeaker 19 in an audible manner. Such notification may be displayed on image display region 6 instead of or in addition to the notification by loudspeaker 19. That is, the notify unit making such notification is not limited to the loudspeaker.

1-17. The game machines l, 10 each constitute: a ball flipping game machine which provides a game in which balls are flipped into a play field; an image display type game machine which provides an image display of play media emitted into a play field; and a ball flipping game machine of an image display type which provides an image display of flipped balls entering into a play field.

1-18. Ball count select buttons 270A–270F constitute shooting count selection units with which the player selects a shooting count of the play media from among a predetermined number of different shooting counts. The shooting count selection units (270A–270F) are prepared for the respective shooting counts of the play media.

1-19. In the game machine 10 having the play board screen as shown in FIG. 12 displayed, a ball count change button may be provided which allows the shooting count once set to be decremented by 1 at each manipulation thereof. In this case, the ball count change button constitutes a shooting count change unit with which the manipulation to reduce the shooting count of the play media can be performed, or a shooting count change unit with which the manipulation to decrement the shooting count of the play media one by one can be performed.

1-20. The game machine 10 having the play board screen as shown in FIG. 12 displayed may be configured such that the game content becomes more advantageous to the player as the ball count set for one game is increased. For example, the winning probability that a ball enters a winning hole may be increased as a greater number of balls are set to be shot in one game. More specifically, the winning probability for one flipped ball to enter a winning hole in the case where the ball count is set to 50 may be made 1.5 times or twice greater than the winning probability in the case with the ball count of 25. Alternatively, the probability that reels 38A, 38B, 38C show a "hit" combination as the display results may be increased as the number of balls to be shot in one game is increased. Further, the probability that a ball enters spin starter winning hole 34A may also be increased as a greater number of balls are set to be shot in one game. From the foregoing, the distinctive feature that "the game state is controlled to attain a state advantageous to the player in accordance with the shooting count of the play media having been set" or that "the play control unit causes the game state advantageous to the player to be attained in accordance with the shooting count of the play media having been set" is disclosed. In this case, it may be configured such that even a difference of one count in the shooting count having been set affects the degree of advantage for the player. This intensifies the benefits of the game machine 1 which can set the ball shooting count meticulously on a per ball basis.

1-21. In the game machine 10 having the play board screen as shown in FIG. 12 displayed, variable displays of reels 38A, 38B, 38C may also be started, not based on the spin starter win, but with the start of the game, as in the game machine 10 having the play board screen as shown in FIG. 13 displayed. In this case, a winning entry of a ball into winning hole 34A may be stored so that reels 38A, 38B, 38C can restart varying displays based on the win stored.

Similarly, in the game machine 10 having the play board screen as shown in FIG. 13 displayed, variable displays of reels 38A, 38B, 38C may also be started based on the spin starter win, as in the game machine 10 having the play board screen as shown in FIG. 12 displayed.

1-22. Besides the shooting start input unit and the shooting stop input unit formed with the transparent electrode films, a second shooting start input unit (e.g., start button 23) for the user to enter the input to start shooting the play media and a second shooting stop input unit (e.g., end button 24) for the user to enter the input to stop shooting the play media are further provided.

1-23. A game machine (1) manipulable by a player includes: a play field (7); a variable winning region (e.g., winning hole 30B) which is provided in the play field and changeable between a first state advantageous to the player and a second state disadvantageous to the player; a first input detection unit (e.g., S4) which detects an input from the player to start shooting play media (e.g., balls); a second input detection unit (e.g., S21, SB6) which detects an input from the player to stop shooting the play media; and a shooting control unit (e.g., S12, S24, SB3) which starts control for shooting the play media sequentially into the play field in accordance with a predetermined shooting pattern in response to the first input detection unit detecting the input from the player to start shooting the play media, and controls to stop shooting the play media in response to the second input detection unit detecting the input from the player to stop shooting the play media. When the second input detection unit detects the relevant input from the player during a predetermined specific play state (advantageous to the player) in which the variable winning region attains the first state, the shooting control unit controls to stop shooting the play media after expiration of the specific play state (e.g., S2, S18, S19, S23).

With such a configuration, when the player's input to stop shooting the play media is detected during the specific play state where the variable winning region is in the first state, the ball shooting is stopped after the specific play state is finished. Thus, the player who wants to finish the game play at the end of the specific play state does not need to manipulate the game machine aiming at the right timing at the end of the specific play state. What he/she needs to do is only perform the end manipulation in advance at an arbitrary timing during the specific play state. This improves manipulability of the player. In addition, the possibility is eliminated that the player performs the end manipulation so early that the ball shooting is stopped before the end of the specific play state, wasting the precious opportunity of the specific play state.

1-24. As an example of the "predetermined specific play state", the play state where the big winning hole (or variable ball-receiving unit) is widely open was described. However, the specific play state is not limited thereto. It may be any of a "play state where the big winning hole (or variable ball-receiving unit) is apt to open", a "play state where wins are likely to occur", a "play state where balls are inclined to enter a spin starter winning hole" and a "state with an increased probability that the variable display devices show a "hit" combination as the display results", or any combination of at least two of them. All that is needed is that the state is advantageous to the player.

1-25. In the first embodiment, when reels 38A, 38B, 38C show a "hit" combination as the display results while ball shooting is being stopped, the ball shooting is resumed automatically without a start manipulation. Instead of such a configuration, manipulation of end button 240 by the player in the presence of a spin starter win stored may cause the start of variable displays of reels 38A, 38B, 38C to be suspended. Alternatively, manipulation of end button 240 by the player during the scrolling of reels 38A, 38B, 38C may cause the scrolling of the reels to be temporarily stopped or to be continued until a start manipulation is detected.

1-26. A game machine provided with a casing (e.g., front frame 2) and a play field (7) having a winning region (e.g., respective winning holes 30A–30F) into which a play medium (e.g., a ball) can enter to achieve a win includes: a shooting start detection unit (e.g., S4) which detects an input from a user to start shooting the play media; a shooting device (e.g., ball shooting device 45) which shoots the play media into the play field; a shooting control unit (e.g., microcomputer 44) which automatically determines shooting strength of the play media by the shooting device, and starts control for shooting the play media in response to the shooting start detection unit detecting the input from the user to start shooting the play media; and a strength change detection unit (e.g., sensor 39) which detects a manipulation for changing the shooting strength of the shooting device. The shooting control unit includes an adjustment unit (e.g., see FIG. 15) which adjusts the shooting strength of the shooting device in accordance with the detected result of the strength change detection unit.

1-27. In the process illustrated in FIG. 6, the value of the available ball counter is decremented by 1 every time a ball is shot (S10), and determination is made whether the value of the counter has reached 0 (S6) to decide whether all the available balls have been shot. Alternatively, a first counter storing the number of available balls for shooting and a second counter counting the number of balls having been shot may be provided, with only the value of the second counter being incremented by 1 for each ball shot. In this case, decision as to whether all the available balls have been shot can be made by determining whether the values of the first counter and the second counter match with each other.

1-28. As described above, game machine 10 described as the second embodiment may be provided with a button (e.g., shooting stop button) with which ball shooting can be stopped at an arbitrary timing before all the balls set are shot, as in game machine 1 described as the first embodiment. In this case, the game machine 10 described as the second embodiment realizes a game machine having the following features.

The game machine (10) provided with a casing (e.g., front frame 2) and a play field (7) having a winning region (e.g., respective winning holes 34A–34E) into which a play medium (e.g., a ball) can enter to achieve a win includes: a shooting count selection unit (e.g., ball count select buttons 270A–270F) with which a player can select one of a predetermined number of different plural numbers as a shooting count of the play media; a shooting count setting unit which sets the plural number selected by the player via the shooting count selection unit as the shooting count for one game; a shooting count storage unit which stores the number of available play media for shooting into the play field (e.g., an available ball counter for storing the number of available balls that is to be displayed on BALL REMAINING display portion 216); a start detection unit which detects an input from the user (e.g., manipulation of start button 230) to start shooting the play media into the play field; a shooting control unit which initiates shooting the play media into the play field in response to the start detection unit detecting the input from the user to start shooting the play media, and controls to stop shooting the play media in response to all the available play media having been shot; and a stop detection unit which detects an input from the user to stop shooting the play media (e.g., the shooting stop button described in the second embodiment as the modification thereof). The shooting control unit can control to start the shooting operation of the play media into the play field when a shooting count of a maximum number selectable is selected by manipulation of the shooting count selection unit (e.g., manipulation of ball count select button (max ball button) 270F), even if the input from the user to start shooting the play media is undetected. It can also control to stop shooting the play media in response to the stop detection unit detecting the input from the user to stop shooting the play media.

2-1. A game machine provided with a casing (e.g., front frame 2) and a play field (7) having a winning region (e.g., respective winning holes 30A–30F) into which a play medium (e.g., a bail) can enter to achieve a win includes:

- a storage unit (e.g., an available ball counter) which stores the number of available play media for shooting into the play field;
- a start detection unit (e.g., S4) which detects an input from a user (e.g., manipulation of start button 230) to start shooting the play media into the play field;
- a stop detection unit (e.g., S21, SB6) which detects an input from the user to stop shooting the play media; and
- a shooting control unit (e.g., S6, S12, S13) which initiates shooting the play media into the play field in response to the start detection unit detecting the input from the user to start shooting the play media, and controls to stop shooting the play media in response to all the available play media having been shot, wherein, when the stop detection unit detects the input from the user to stop shooting the play media during a predetermined specific play state, the shooting control unit controls to stop shooting the play media at a predetermined timing associated with a finish time of the specific play state (e.g., S2, S18, S19, S23).

According to the configuration described above, when the user's input to stop shooting the play media is detected during the specific play state, the shooting of the play media is stopped at a prescribed timing associated with the finish time of the specific play state. Thus, if the player wants to finish the game play at the end of the specific play state, he/she only needs to enter the input to stop shooting the play media in advance at an arbitrary timing during the specific play state, instead of manipulating the game machine aiming at a right timing at the end of the specific play state. This improves manipulability of the player.

2-2. The game machine further includes a display unit (e.g., BALL REMAINING display portion 216) which identifiably displays the number of available play media stored in the storage unit.

With such a configuration, the number of available play media for shooting can readily be confirmed.

2-3. Assume that, after expiration of the specific play state, while the shooting of the play media is being stopped, the specific play state is regained based on the play medium having been emitted into the play field before the end of the relevant specific play state. In such a case, the shooting control unit controls to resume the shooting operation of the play media, even if the start detection unit does not detect the user input (e.g., S28, S30, S31).

With such a configuration, in the case where the specific play state is regained after the end of the specific play state based on the play medium having been shot into the play field before the end of the relevant specific play state, the shooting of the play media into the play field is resumed even if the user's input to start shooting the play media is undetected. Accordingly, the player is unnecessary to hastily enter such an input upon recovery of the specific play state, and thus, the manipulability is improved. Further, the player is allowed to make the best use of the specific play state without wasting it.

2-4. The shooting control unit causes the shooting operation of the play media to be continued, once the specific play state is attained, even after all the available play media have been shot (e.g., S6, S9).

In this case, the game machine further includes a subtraction unit which subtracts a monetary value corresponding to the number of play media having been shot exceeding the number of the available play media from a monetary value awarded to the player corresponding to wins during the specific play state (e.g., the available ball counter is once updated to a negative value and then updated to a value not smaller than 0 in accordance with the wins).

Such a configuration allows, when the specific play state is attained, the player to continue shooting the play media even if he/she runs out of the ball, without making the player disgusted by wasting the precious opportunity of the specific play state. Therefore, it can provide a game play giving consideration to the player's feelings. Furthermore, the monetary value corresponding to the number of the play media having been shot exceeding the number of the available play media is subtracted from the monetary value being awarded to the player in response to the wins during the specific play state. Accordingly, it is possible to restrict the monetary value owned by the player to a proper amount, avoiding occurrence of disbenefit on the game provider's side.

2-5. The play field, the play medium and the winning region are displayed as images by an image display device (e.g., CRT display device 139) mounted to the game machine.

Such a configuration eliminates problems like a ball jam in a winning region, so that maintenance of the game machine is facilitated.

2-6. The game machine further includes a selection detection unit (e.g., S33) which detects the user's selection of a play field, wherein the image display device displays one of a predetermined number of different play fields in accordance with the selection detected by the selection detection unit (e.g., see FIG. 3).

With such a configuration, the player is allowed to select a desired one of the plurality of play fields. A single game machine can provide a plurality of games having different play fields.

2-7. The game machine further includes a notify-unit (e.g., loudspeaker 19) which notifies of information about a timing of stopping the shooting of the play media when the stop detection unit detects the user's input to stop shooting the play media during the specific play state.

With such a configuration, in the case where the user's input to stop shooting the play media is detected during the specific play state, the information about when the shooting of the play media is to be stopped is notified, so that the player can confirm that the manipulation was accepted without fault. This avoids a situation that, although the player's input to stop shooting the play media was undetected due to poor manipulation or the like, the player continues to play, believing that the manipulation was valid, and is startled to find that the shooting of the play media is not stopped at a prescribed timing in association with the finish time of the specific play state. It also prevents the player from wondering why the shooting of the play media is not stopped immediately despite his/her input to stop the same.

2-8. The game machine further includes a notify unit (e.g., loudspeaker 19) which makes notification that the shooting operation of the play media is continued, even though all the available play media have been shot, because the specific play state has been attained.

With such a configuration, the player is prevented from having needless doubts and being puzzled about the fact that the shooting of the play media is continued even though all the available play media have been shot.

2-9. The input unit provided in the game machine for manipulation thereof includes a cash-out button 20 (200), a change button 21 (210), a start button 23 (230), an end button 24 (240), and a reset button 220. Instead of such operation buttons, a mouse or a track ball may be employed to manipulate the game machine.

Start button 23 (230) constitutes a play start input unit with which a start manipulation of the game play can be performed and a shooting start input unit with which a manipulation for starting shooting the play media can be performed. End button 24 (240) constitutes a play end input unit with which an end manipulation of the game play can be performed and a shooting stop input unit with which a manipulation for stopping shooting the play media can be performed. A touch screen 60 is formed of a transparent electrode film, and constitutes a position detection unit which, when the player touches a prescribed position, detects the relevant position. In this game machine, the play field is covered by the position detection unit (i.e., covered by the transparent electrode film).

2-10. In the game machine shown in FIG. 2, all the available balls are shot unless end button 24 (240) is manipulated. Alternatively, the ball shooting may be stopped automatically once balls of a predetermined, unitary ball count (of, e.g., 20 balls) have been shot, even if there still are remaining balls. In this case, another set of balls of the unitary ball count may be emitted additionally when the start manipulation is performed after completion of the shooting of the first set of balls of the unitary ball count. Further, the ball shooting may be suspended by manipulation of end button 24 (240) during the shooting of the balls of the unitary ball count. In this case, the shooting control unit is configured to start control of shooting of the play media of a predetermined, unitary ball count sequentially into the play field in accordance with a predetermined shooting pattern, in response to a first input detection unit detecting an input from the user to start shooting the play media. The unitary ball count (the unitary count) may be made changeable by manipulation of the player. Further, a unitary ball count setting button for performing such manipulation may be provided in the game machine to allow the unitary ball count to be set when its manipulation is detected by the game machine. In this case, the unitary ball count setting button constitutes a unitary count setting input unit with which a manipulation for setting the unitary count can be performed. Still further, a setting detection unit detecting the manipulation for setting the unitary count is disclosed. The unitary ball count setting button may be implemented by touch screen 60.

2-11. The game machine may be made playable using a prepaid card. For example, a card processor for processing the prepaid card is connected to the game machine 1. When a prepaid card is inserted into the card processor, a predetermined amount is withdrawn from the balance on the card, and balls of the number corresponding to the withdrawn amount are afforded to the player. At the settlement of the account, instead of payout of the coins, information that can identify the number of available balls to the player may be recorded on a recording medium (e.g., a membership card) owned by the player.

2-12. CPU 150 constitutes a play control unit which controls the play state of the game machine. Reels 38A, 38B, 38C constitute variable display devices having their display states changeable. CPU 150 also constitutes a variable display control unit which controls production of display results of the variable display devices. When the display results of the variable display devices show a predetermined, specific display appearance (e.g., 777), the play state can be changed to a specific play state advantageous to the player. In this specific play state, big winning hole 30B repeatedly changes between an open state and a closed state for a predetermined period of time. However, the operating manner of big winning hole 30B during the specific play state is not limited thereto; it may maintain the open state through the specific play state. Big winning hole (or variable winning hole) 30B maintains a state inhibiting entry of a ball during the normal play state, whereas it changes between a state allowing entry of the ball and the state inhibiting entry of the ball during the specific play state. Alternatively, big winning hole (variable winning hole) 30B may be configured to change between a state where entry of the ball is allowed but difficult due to narrow clearance between a pair of movable fragments and a state where entry of the ball is easy.

2-13. Cash-out button 20 (200) constitutes an accounting input unit with which a manipulation for settling the play result can be performed. Alternatively, cash-out button 20 (200) may be configured such that manipulation thereof enables stopping of the ball shooting as well as subsequent accounting operation, as described in conjunction with FIG. 10. In this case, cash-out button 20 (200) constitutes the play end input unit with which an end manipulation of the game play can be performed and the shooting stop input unit with which a manipulation for stopping the shooting of the play media can be performed. The cash-out button serves as both the accounting input unit and the play end input unit (or the shooting stop input unit).

The graphic representations of the play board screens 1A, 1B shown in FIG. 3 each constitute a selection input unit with which a play field (or a kind of the game machine) can be selected.

2-14. A shooting suspension period may be provided in which ball shooting is suspended automatically for a predetermined period of time (e.g., 10 seconds) after expiration of the specific play state, even if balls are remaining. In this case, it may be configured such that the ball shooting is stopped completely when manipulation of the end button or the cash-out button is detected during this shooting suspension period, until the start manipulation is detected afterwards.

Provision of such a shooting suspension period allows the player who wants to ultimately finish the game play at the end of the specific play state to perform the end manipulation during this shooting suspension period without being pressed for time.

As such, the distinctive feature that "the shooting control unit controls to stop shooting the balls automatically upon expiration of the specific play state where the variable winning region (e.g., big or variable winning hole 30B) attains a first state advantageous to the player", or that "the shooting control unit controls to stop shooting the balls automatically for a predetermined period of time after the expiration of the specific play state where the variable winning region attains the first state" is disclosed 2-15. The variable winning region (or variable ball-receiving unit) becomes changeable from a second state disadvantageous to the player to a first state advantageous to the player in accordance with the display results of the variable display devices (reels 38A, 38B, 38C). The variable display devices start varying displays based on a spin starter win stored. A spin starter win stored count display portion for displaying the count of the stored spin starter wins may further be provided in image display region 6 of the game machine.

There is a case where, after the specific play state is finished, the variable display devices are controlled to produce display results based on the play medium emitted into the play field before the end of the specific play state, and the display results thus produced show the above-described specific display appearance. In such a case, the shooting control unit controls to resume shooting the play media into the play field automatically, even if the first input detection unit does not detect the user input.

2-16. In the case where the player runs out of the ball during the specific play state, the ball shooting is continued with the value of the available ball counter updated to a negative value. Alternatively, the balls may be shot with the value of the available ball counter maintained at 0 and incremented when a win occurs. In this case, the balance of the player can be adjusted, once the value of the available ball counter outnumbers the balls having been shot, by subtracting the number of flipped balls from the value of the counter. Yet alternatively, upon runout of the ball during the specific play state, a prescribed value may be added to the available ball counter to let the ball shooting continue (the value should be sufficient enough to allow continuation of the game play during the specific play state in consideration of wins expected during the relevant state, for example). The prescribed value thus initially added to the available ball counter can be subtracted therefrom when the accounting manipulation is performed or upon expiration of the specific play state.

A certain amount of points (or available balls) may be awarded to the player as a privilege of the specific play state. In this case, it is desirable, from the standpoint of fair treatment, to award a predetermined, fixed amount of points to a player every time the specific play state is attained, regardless of whether the player owns balls or not at the moment.

2-17. When the stop-scheduled flag is set on in S23, notification that the ball shooting is stopped after the specific play state is finished is made by loudspeaker 19 in an audible manner. When it is determined YES in S9 and the process goes to S10, notification that the ball shooting is continued with the available ball count taking a negative value is made again by loudspeaker 19 in an audible manner. Such notification may be displayed on image display region 6 instead of or in addition to the notification by loudspeaker 19. That is, the notify unit making such notification is not limited to the loudspeaker.

2-18. The game machines 1, 10 each constitute: a ball flipping game machine which provides a game in which balls are flipped into a play field; an image display type game machine which provides an image display of play media emitted into a play field; and a ball flipping game machine of an image display type which provides an image display of flipped balls entering into a play field.

2-19. Ball count select buttons 270A–270F constitute shooting count selection units with which the player selects a shooting count of the play media from among a predetermined number of different shooting counts. The shooting count selection units (270A–270F) are prepared for the respective shooting counts of the play media.

2-20. In the game machine 10 having the play board screen as shown in FIG. 12 displayed, a ball count change button may be provided which allows the shooting count once set to be decremented by 1 at each manipulation thereof. In this case, the ball count change button constitutes a shooting count change unit with which the manipulation to reduce the shooting count of the play media can be performed, or a shooting count change unit with which the manipulation to decrement the shooting count of the play media one by one can be performed.

2-21. The game machine 11 having the play board screen as shown in FIG. 12 displayed may be configured such that the game content becomes more advantageous to the player as the ball count set for one game is increased. For example, the winning probability that a ball enters a winning hole may be increased as a greater number of balls are set to be shot in one game. More specifically, the winning probability for one flipped ball to enter a winning hole in the case where the ball count is set to 50 may be made 1.5 times or twice greater than the winning probability in the case with the ball count of 25. Alternatively, the probability that reels 38A, 38B, 38C show a "hit" combination as the display results may be increased as the number of balls to be shot in one game is increased. Further, the probability that a ball enters spin starter winning hole 34A may also be increased as a greater number of balls are set to be shot in one game. From the foregoing, the distinctive feature that "the game state is controlled to attain a state advantageous to the player in accordance with the shooting count of the play media having been set" or that "the play control unit causes the game state advantageous to the player to be attained in accordance with the shooting count of the play media having been set" is disclosed. In this case, it may be configured such that even a difference of one count in the shooting count having been set affects the degree of advantage for the player. This intensifies the benefits of the game machine 1 which can set the ball shooting count meticulously on a per ball basis.

2-22. In the game machine 10 having the play board screen as shown in FIG. 12 displayed, variable displays of reels 38A, 38B, 38C may also be started, not based on the spin starter win, but with the start of the game, as in the game machine 10 having the play board screen as shown in FIG. 13 displayed. In this case, a winning entry of a ball into winning hole 34A may be stored so that reels 38A, 38B, 38C can restart varying displays based on the win stored.

Similarly, in the game machine 10 having the play board screen as shown in FIG. 13 displayed, variable displays of reels 38A, 38B, 38C may also be started based on the spin starter win, as in the game machine 10 having the play board screen as shown in FIG. 12 displayed.

2-23. Besides the shooting start input unit and the shooting stop input unit formed with the transparent electrode films, a second shooting start input unit (e.g., start button 23) for the user to enter the input to start shooting the play media and a second shooting stop input unit (e.g., end button 24) for the user to enter the input to stop shooting the play media are further provided.

2-24. A game machine (1) manipulable by a player includes: a play field (7); a variable winning region (e.g., winning hole 30B) which is provided in the play field and changeable between a first state advantageous to the player and a second state disadvantageous to the player; a first input detection unit (e.g., S4) which detects an input from the player to start shooting play media (e.g., balls); a second input detection unit (e.g., S21, SB6) which detects an input from the player to stop shooting the play media; and a shooting control unit (e.g., S12, S24, SB3) which starts control for shooting the play media sequentially into the play field in accordance with a predetermined shooting pattern in response to the first input detection unit detecting the input from the player to start shooting the play media, and controls to stop shooting the play media in response to the second input detection unit detecting the input from the player to stop shooting the play media. When the second input detection unit detects the relevant input from the player during a predetermined specific play state (advantageous to the player) in which the variable winning region attains the first state, the shooting control unit controls to stop shooting the play media after expiration of the specific play state (e.g., S2, S18, S19, S23).

With such a configuration, when the player's input to stop shooting the play media is detected during the specific play state where the variable winning region is in the first state, the ball shooting is stopped after the specific play state is finished. Thus, the player who wants to finish the game play at the end of the specific play state does not need to manipulate the game machine aiming at the right timing at the end of the specific play state. What he/she needs to do is only perform the end manipulation in advance at an arbitrary timing during the specific play state. This improves manipulability of the player. In addition, the possibility is eliminated that the player performs the end manipulation so early that the ball shooting is stopped before the end of the specific play state, wasting the precious opportunity of the specific play state.

2-25. As an example of the "predetermined specific play state", the play state where the big winning hole (or variable ball-receiving unit) is widely open was described. However, the specific play state is not limited thereto. It may be any of a "play state where the big winning hole (or variable ball-receiving unit) is apt to open", a "play state where wins are likely to occur", a "play state where balls are inclined to enter a spin starter winning hole" and a "state with an increased probability that the variable display devices show a "hit" combination as the display results", or any combination of at least two of them. All that is needed is that the state is advantageous to the player.

2-26. In the first embodiment, when reels 38A, 38B, 38C show a "hit" combination as the display results while ball shooting is being stopped, the ball shooting is resumed automatically without a start manipulation. Instead of such a configuration, manipulation of end button 240 by the player in the presence of a spin starter win stored may cause the start of variable displays of reels 38A, 38B, 38C to be suspended. Alternatively, manipulation of end button 240 by the player during the scrolling of reels 38A, 38B, 38C may cause the scrolling of the reels to be temporarily stopped or to be continued until a start manipulation is detected.

2-27; A game machine provided with a casing (e.g., front frame 2) and a play field (7) having a winning region (e.g., respective winning holes 30A–30F) into which a play medium (e.g., a ball) can enter to achieve a win includes: a shooting start detection unit (e.g., S4) which detects an input from a user to start shooting the play media; a shooting device (e.g., ball shooting device 45) which shoots the play media into the play field, a shooting control unit (e.g., microcomputer 44) which automatically determines shooting strength of the play media by the shooting device, and starts control for shooting the play media in response to the shooting start detection unit detecting the input from the user to start shooting the play media; and a strength change detection unit (e.g., sensor 39) which detects a manipulation for changing the shooting strength of the shooting device. The shooting control unit includes an adjustment unit (e.g., see FIG. 15) which adjusts the shooting strength of the shooting device in accordance with the detected result of the strength change detection unit.

2-28. In the process illustrated in FIG. 6, the value of the available ball counter is decremented by 1 every time a ball is shot (S10), and determination is made whether the value of the counter has reached 0 (S6) to decide whether all the available balls have been shot. Alternatively, a first counter storing the number of available balls for shooting and a second counter counting the number of balls having been shot may be provided, with only the value of the second counter being incremented by 1 for each ball shot. In this case, decision as to whether all the available balls have been shot can be made by determining whether the values of the first counter and the second counter match with each other.

2-29. As described above, game machine 10 described as the second embodiment may be provided with a button (e.g., shooting stop button) with which ball shooting can be stopped at an arbitrary timing before all the balls set are shot, as in game machine 1 described as the first embodiment. In this case, the game machine 10 described as the second embodiment realizes a game machine having the following features.

The game machine (10) provided with a casing (e.g., front frame 2) and a play field (7) having a winning region (e.g., respective winning holes 34A–34E) into which a play medium (e.g., a ball) can enter to achieve a win includes: a shooting count selection unit (e.g., ball count select buttons 270A–270F) with which a player can select one of a predetermined number of different plural numbers as a shooting count of the play media; a shooting count setting unit which sets the plural number selected by the player via the shooting count selection unit as the shooting count for one game; a shooting count storage unit which stores the number of available play media for shooting into the play field (e.g., an available ball counter for storing the number of available balls that is to be displayed on BALL REMAINING display portion 216); a start detection unit which detects an input from the user (e.g., manipulation of start button 230) to start shooting the play media into the play field; a shooting control unit which initiates shooting the play media into the play field in response to the start detection unit detecting the input from the user to start shooting the play media, and controls to stop shooting the play media in response to all the available play media having been shot; and a stop detection unit which detects an input from the user to stop shooting the play media (e.g., the shooting stop button described in the second embodiment as the modification thereof). The shooting control unit can control to start the shooting operation of the play media into the play field when a shooting count of a maximum number selectable is selected by manipulation of the shooting count selection unit (e.g., manipulation of ball count select button (max ball button) 270F), even if the input from the user to start shooting the play media is undetected. It can also control to stop shooting the play media in response to the stop detection unit detecting the input from the user to stop shooting the play media.

2-30. In the embodiments described above, the route of the ball can be changed by touching touch screen 60 provided on the play field. Alternatively, a manipulation switch for adjustment of ball shooting strength may be provided in the game machine to allow the route of the ball to be changed by manipulation of the manipulation switch by the player. For example, a slide switch designed to increase the shooting strength by sliding it in one direction and to decrease the shooting strength by sliding it in an opposite direction, or a push switch designed to increase the shooting strength by applying more pressure to make it further depressed, can be employed as the manipulation switch. Alternatively, a sensor such as an infrared sensor sensing an infrared signal generated by a remote controller may be provided in the game machine to allow the flipped balls to converge on a position designated by manipulation of the controller. Yet alternatively, manipulation switches corresponding to respective winning holes, or manipulation switches corresponding to different positions of the play field may be provided in the game machine to allow the flipped balls to converge on a winning hole or a position of the play field that is designated by manipulation of the relevant manipulation switch.

2-31. In the first embodiment, the specific play state is terminated after winning hole 30B, for example, repeatedly changes between the first state advantageous to the player allowing entry of a ball into the hole and the second state disadvantageous to the player inhibiting entry of the ball into the hole over a predetermined period of time. When a stop manipulation is detected during the specific play state, the ball shooting is stopped when the specific play state is finished (at the time point when the winning hole 30B has finished to change from the first state to the second state).

In this case, the ball shooting may be stopped exactly at the time point when the specific play state is finished, or immediately before the end of the specific play state. Alternatively, the ball shooting may be stopped immediately after the end of the specific play state.

For example, the time required for a flipped ball to arrive at the winning hole 30B may be taken into consideration, and the ball shooting may be stopped ahead of the end of the specific play state by the relevant arrival time of the ball. With such a configuration, any ball is prevented from reaching winning hole 30B after dosing thereof, which is more effective to avoid wasteful shooting of the balls.

In particular, in the case of the game machine having balls displayed as images, the ball shooting may be stopped immediately after display of the image of shooting a ball that is predetermined to enter the winning hole 30B lastly in the specific play state.

The aforementioned "predetermined timing associated with a finish time of the specific play state" is a broad concept that includes any timing described above (in 2-31).

3-1. A game machine provided with a casing (e.g., front frame 2) and a play field (7) having a winning region (e.g., respective winning holes 30A–30F) into which a play medium (e.g., a ball) can enter to achieve a win includes:

a storage unit (e.g., an available ball counter) which stores the number of available play media for shooting into the play field;

a start detection unit (e.g., S4) which detects an input from a user (e.g., manipulation of start button 230) to start shooting the play media into the play field;

a shooting control unit (e.g., S6, S12, S13) which initiates shooting the play media into the play field in response to the start detection unit detecting the input from the user to start shooting the play media, and controls to stop shooting the play media in response to all the available play media having been shot; and a route change detection unit (e.g., SA5, SA8, SA12, SA13) which detects a manipulation for changing the route of the play media, wherein the shooting control unit includes a route change unit (e.g., SA6, SA9, SA14, SA16) which changes the route of the play media in response to a detected result of the route change detection unit.

Such a configuration allows the shooting operation of the play media into the play field to be started by the user's input to start shooting the play media. It also enables the user's manipulation for changing the route of the play media. Accordingly, the player can play the game with relatively simple manipulations and enjoy the feeling that he/she can participate in deciding the routes of the play media.

3-2. The game machine further includes a display unit (e.g., BALL REMAINING display portion 216) which identifiably displays the number of available play media stored in the storage unit.

With such a configuration, the number of available play media for shooting can readily be confirmed.

3-3. The route change detection unit detects a position in the play field designated by the route change manipulation (e.g., a position of a winning hole designated by the player is detected), and the route change unit changes the route of the play media in a direction toward the position detected by the route change detection unit (e.g., toward the winning hole designated by the player).

With such a configuration, it is possible for the player to designate a desired position in the play field to make the play media converge thereon. Accordingly, the player is able to control the routes of the play media, so that the fascinating aspect of the game is intensified.

3-4. The input unit for the route change manipulation is formed with a transparent electrode film (e.g., touch screen 60) placed on the play field.

With such a configuration, the route change manipulation can be performed simply by touching the transparent electrode film with a finger, so that manipulability is improved.

3-5. The play field, the play medium and the winning region are displayed as images by an image display device (e.g., CRT display device 139) mounted to the game machine.

Such a configuration eliminates problems like a ball jam in a winning region, so that maintenance of the game machine is facilitated.

3-6. The game machine further includes a shooting device (e.g., a ball shooting device) for shooting the play medium into the play field, a position detection unit (e.g., sensor 39) which detects a position of the play medium in the play field, and an adjustment unit (e.g., a microcomputer) which adjusts shooting strength of the shooting device based on a detected result of the position detection unit and a detected result of the route change detection unit.

With such a configuration, the shooting strength of the shooting device can be adjusted based on the detected results of the position detection unit and the route change detection unit, so that the play media can be shot anywhere as desired by the player.

3-7. A game machine provided with a casing (e.g., front frame 2) and a play field (7) having a plurality of winning regions (e.g., winning hole 30A–30F) into each of which a play medium (e.g., a ball) can enter to achieve a win includes:

a storage unit (e.g., an available ball counter) which stores the number of available play media for shooting into the play field;

a start detection unit (e.g., S4) which detects an input from a user (e.g., manipulation of start button 230) to start shooting the play media into the play field;

a shooting control unit (e.g., S6, S12, S13) which initiates shooting the play media into the play field in response to the start detection unit detecting the input from the user to start shooting the play media, and controls to stop shooting the play media in response to all the available play media having been shot; and a winning region detection unit (e.g., SA5, SA8, SA12, SA13) which detects one of the plurality of winning regions selected by the player, wherein the shooting control unit causes the play media to be shot in such a manner that a probability for the play medium to enter the winning region detected by the winning region detection unit increases.

With such a configuration, the winning probability for the winning region designated by the player is increased, so that the fascinating aspect of the game is intensified.

3-8. The play field includes various winning regions (e.g., normal winning hole 30C–30F, big winning hole 30B, spin starter winning hole 30A) which are different in play value to be awarded to the player upon entry of the play medium therein (here, the play value may be, e.g., the number of coins to be awarded, or whether a condition for the reels to start varying displays is satisfied or not).

With such a configuration, various winning regions for which different play values are preset to be awarded to the player upon entry of the play medium therein are provided in the play field. It makes the play result vary in accordance with the player's way of manipulation, so that the fascinating aspect of the game is intensified.

3-9. The input unit provided in the game machine for manipulation thereof includes a cash-out button 20 (200), a change button 21 (210), a start button 23 (230), an end button 24 (240), and a reset button 220. Instead of such operation buttons, a mouse or a track ball may be employed to manipulate the game machine.

Start button 23 (230) constitutes a play start input unit with which a start manipulation of the game play can be performed and a shooting start input unit with which a manipulation for starting shooting the play media can be performed. End button 24 (240) constitutes a play end input unit with which an end manipulation of the game play can be performed and a shooting stop input unit with which a manipulation for stopping shooting the play media can be performed. A touch screen 60 is formed of a transparent electrode film, and constitutes a position detection unit which, when the player touches a prescribed position, detects the relevant position. In this game machine, the play field is covered by the position detection unit (i.e., covered by the transparent electrode film).

3-10. In the game machine shown in FIG. 2, all the available balls are shot unless end button 24 (240) is manipulated. Alternatively, the ball shooting may be stopped automatically once balls of a predetermined, unitary ball count (of, e.g., 20 balls) have been shot, even if there still are remaining balls. In this case, another set of balls of the unitary ball count may be emitted additionally when the start manipulation is performed after completion of the shooting of the first set of balls of the unitary ball count. Further, the ball shooting may be suspended by manipulation of end button 24 (240) during the shooting of the balls of the unitary ball count. In this case, the shooting control unit is configured to start control of shooting of the play media of a predetermined, unitary ball count sequentially into the play field in accordance with a predetermined shooting pattern, in response to a first input detection unit detecting an input from the user to start shooting the play media. The unitary ball count (the unitary count) may be made changeable by manipulation of the player. Further, a unitary ball count setting button for performing such manipulation may be provided in the game machine to allow the unitary ball count to be set when its manipulation is detected by the game machine. In this case, the unitary ball count setting button constitutes a unitary count setting input unit with which a manipulation for setting the unitary count can be performed. Still further, a setting detection unit detecting the manipulation for setting the unitary count is disclosed. The unitary ball count setting button may be implemented by touch screen 60.

3-11. The game machine maybe made playable using a prepaid card. For example, a card processor for processing the prepaid card is connected to the game machine 1. When a prepaid card is inserted into the card processor, a predetermined amount is withdrawn from the balance on the card, and balls of the number corresponding to the withdrawn amount are afforded to the player. At the settlement of the account, instead of payout of the coins, information that can identify the number of available balls to the player may be recorded on a recording medium (e.g., a membership card) owned by the player.

3-12. CPU 150 constitutes a play control unit which controls the play state of the game machine. Reels 38A, 38B, 38C constitute variable display devices having their display states changeable. CPU 150 also constitutes a variable display control unit which controls production of display results of the variable display devices. When the display results of the variable display devices show a predetermined, specific display appearance (e.g., 777), the play state can be changed to a specific play state advantageous to the player. In this specific play state, big winning hole 30B repeatedly changes between an open state and a closed state for a predetermined period of time. However, the operating manner of big winning hole 30B during the specific play state is not limited thereto; it may maintain the open state through the specific play state. Big winning hole (or variable winning hole) 30B maintains a state inhibiting entry of a ball during the normal play state, whereas it changes between a state allowing entry of the ball and the state inhibiting entry of the ball during the specific play state. Alternatively, big winning hole (variable winning hole) 30B may be configured to change between a state where entry of the ball is allowed but difficult due to narrow clearance between a pair of movable fragments and a state where entry of the ball is easy.

3-13. Cash-out button 20 (200) constitutes an accounting input unit with which a manipulation for settling the play result can be performed. Alternatively, cash-out button 20 (200) may be configured such that manipulation thereof enables stopping of the ball shooting as well as subsequent accounting operation, as described in conjunction with FIG. 10. In this case, cash-out button 20 (200) constitutes the play end input unit with which an end manipulation of the game play can be performed and the shooting stop input unit with which a manipulation for stopping the shooting of the play media can be performed. The cash-out button serves as both the accounting input unit and the play end input unit (or the shooting stop input unit).

The graphic representations of the play board screens 1A, 1B shown in FIG. 3 each constitute a selection input unit with which a play field (or a kind of the game machine) can be selected.

3-14. A shooting suspension period may be provided in which ball shooting is suspended automatically for a predetermined period of time (e.g., 10 seconds) after expiration of the specific play state, even if balls are remaining. In this case, it may be configured such that the ball shooting is stopped completely when manipulation of the end button or the cash-out button is detected during this shooting suspension period, until the start manipulation is detected afterwards.

Provision of such a shooting suspension period allows the player who wants to ultimately finish the game play at the end of the specific play state to perform the end manipulation during this shooting suspension period without being pressed for time.

As such, the distinctive feature that "the shooting control unit controls to stop shooting the balls automatically upon expiration of the specific play state where the variable winning region (e.g., big or variable winning hole 30B) attains a first state advantageous to the player", or that "the shooting control unit controls to stop shooting the balls automatically for a predetermined period of time after the expiration of the specific play state where the variable winning region attains the first state" is disclosed.

3-15. The variable winning region (or variable ball-receiving unit) becomes changeable from a second state disadvantageous to the player to a first state advantageous to the player in accordance with the display results of the variable display devices (reels 38A, 38B, 38C). The variable display devices start varying displays based on a spin starter win stored. A spin starter win stored count display portion for displaying the count of the stored spin starter wins may further be provided in image display region 6 of the game machine.

There is a case where, after the specific play state is finished, the variable display devices are controlled to produce display results based on the play medium emitted into the play field before the end of the specific play state, and the display results thus produced show the above-described specific display appearance. In such a case, the shooting control unit controls to resume shooting the play media into the play field automatically, even if the first input detection unit does not detect the user input.

3-16. In the case where the player runs out of the ball during the specific play state, the ball shooting is continued with the value of the available ball counter updated to a negative value. Alternatively, the balls may be shot with the value of the available ball counter maintained at 0 and incremented when a win occurs. In this case, the balance of the player can be adjusted, once the value of the available ball counter outnumbers the balls having been shot, by subtracting the number of flipped balls from the value of the counter. Yet alternatively, upon runout of the ball during the specific play state, a prescribed value may be added to the available ball counter to let the ball shooting continue (the value should be sufficient enough to allow continuation of the game play during the specific play state in consideration of wins expected during the relevant state, for example). The prescribed value thus initially added to the available ball counter can be subtracted therefrom when the accounting manipulation is performed or upon expiration of the specific play state.

A certain amount of points (or available balls) may be awarded to the player as a privilege of the specific play state. In this case, it is desirable, from the standpoint of fair treatment, to award a predetermined, fixed amount of points to a player every time the specific play state is attained, regardless of whether the player owns balls or not at the moment.

3-17. When the stop-scheduled flag is set on in S23, notification that the ball shooting is stopped after the specific play state is finished is made by loudspeaker 19 in an audible manner. When it is determined YES in S9 and the process goes to S10, notification that the ball shooting is continued with the available ball count taking a negative value is made again by loudspeaker 19 in an audible manner. Such notification may be displayed on image display region 6 instead of or in addition to the notification by loudspeaker 19. That is, the notify unit making such notification is not limited to the loudspeaker.

3-18. The game machines 1, 10 each constitute: a ball flipping game machine which provides a game in which balls are flipped into a play field; an image display type game machine which provides an image display of play media emitted into a play field; and a ball flipping game machine of an image display type which provides an image display of flipped balls entering into a play field.

3-19. Ball count select buttons 270A–270F constitute shooting count selection units with which the player selects a shooting count of the play media from among a predetermined number of different shooting counts. The shooting count selection units (270A–270F) are prepared for the respective shooting counts of the play media.

3-20. In the game machine 10 having the play board screen as shown in FIG. 12 displayed, a ball count change button may be provided which allows the shooting count once set to be decremented by 1 at each manipulation thereof. In this case, the ball count change button constitutes a shooting count change unit with which the manipulation to reduce the shooting count of the play media can be performed, or a shooting count change unit with which the manipulation to decrement the shooting count of the play media one by one can be performed.

3-21. The game machine 10 having the play board screen as shown in FIG. 12 displayed may be configured such that the game content becomes more advantageous to the player as the ball count set for one game is increased. For example, the winning probability that a ball enters a winning hole may be increased as a greater number of balls are set to be shot in one game. More specifically, the winning probability for one flipped ball to enter a winning hole in the case where the ball count is set to 50 may be made 1.5 times or twice greater than the winning probability in the case with the ball count of 25. Alternatively, the probability that reels 38A, 38B, 38C show a "hit" combination as the display results may be increased as the number of balls to be shot in one game is increased. Further, the probability that a ball enters spin starter winning hole 34A may also be increased as a greater number of balls are set to be shot in one game. From the foregoing, the distinctive feature that "the game state is controlled to attain a state advantageous to the player in accordance with the shooting count of the play media having been set" or that "the play control unit causes the game state advantageous to the player to be attained in accordance with the shooting count of the play media having been set" is disclosed. In this case, it may be configured such that even a difference of one count in the shooting count having been set affects the degree of advantage for the player. This intensifies the benefits of the game machine 1 which can set the ball shooting count meticulously on a per ball basis.

3-22. In the game machine 10 having the play board screen as shown in FIG. 12 displayed, variable displays of reels 38A, 38B, 38C may also be started, not based on the spin starter win, but with the start of the game, as in the game machine 10 having the play board screen as shown in FIG. 13 displayed. In this case, a winning entry of a ball into winning hole 34A may be stored so that reels 38A, 38B, 38C can restart varying displays based on the win stored.

Similarly, in the game machine 10 having the play board screen as shown in FIG. 13 displayed, variable displays of reels 38A, 38B, 38C may also be started based on the spin starter win, as in the game machine 10 having the play board screen as shown in FIG. 12 displayed.

3-23. Besides the shooting start input unit and the shooting stop input unit formed with the transparent electrode films, a second shooting start input unit (e.g., start button 23) for the user to enter the input to start shooting the play media and a second shooting stop input unit (e.g., end button 24) for the user to enter the input to stop shooting the play media are further provided.

3-24. A game machine (1) manipulable by a player includes: a play field (7); a variable winning region (e.g., winning hole 30B) which is provided in the play field and changeable between a first state advantageous to the player and a second state disadvantageous to the player; a first input detection unit (e.g., S4) which detects an input from the player to start shooting play media (e.g., balls); a second input detection unit (e.g., S21, SB6) which detects an input from the player to stop shooting the play media; and a shooting control unit (e.g., S12, S24, SB3) which starts control for shooting the play media sequentially into the play field in accordance with a predetermined shooting pattern in response to the first input detection unit detecting the input from the player to start shooting the play media, and controls to stop shooting the play media in response to the second input detection unit detecting the input from the player to stop shooting the play media. When the second input detection unit detects the relevant input from the player during a predetermined specific play state (advantageous to the player) in which the variable winning region attains the first state, the shooting control unit controls to stop shooting the play media after expiration of the specific play state (e.g., S2, S18, S19, S23).

With such a configuration, when the player's input to stop shooting the play media is detected during the specific play state where the variable winning region is in the first state, the ball shooting is stopped after the specific play state is finished. Thus, the player who wants to finish the game play at the end of the specific play state does not need to manipulate the game machine aiming at the right timing at the end of the specific play state. What he/she needs to do is only perform the end manipulation in advance at an arbitrary timing during the specific play state. This improves manipulability of the player. In addition, the possibility is eliminated that the player performs the end manipulation so early that the ball shooting is stopped before the end of the specific play state, wasting the precious opportunity of the specific play state.

3-25. As an example of the "predetermined specific play state", the play state where the big winning hole (or variable ball-receiving unit) is widely open was described. However, the specific play state is not limited thereto. It may be any of a "play state where the big winning hole (or variable ball-receiving unit) is apt to open", a "play state where wins are likely to occur", a "play state where balls are inclined to enter a spin starter winning hole" and a "state with an increased probability that the variable display devices show a "hit" combination as the display results", or any combination of at least two of them. All that is needed is that the state is advantageous to the player.

3-26. In the first embodiment, when reels 38A, 38B, 38C show a "hit" combination as the display results while ball shooting is being stopped, the ball shooting is resumed automatically without a start manipulation. Instead of such a configuration, manipulation of end button 240 by the player in the presence of a spin starter win stored may cause the start of variable displays of reels 38A, 38B, 38C to be suspended. Alternatively, manipulation of end button 240 by the player during the scrolling of reels 38A, 38B, 38C may cause the scrolling of the reels to be temporarily stopped or to be continued until a start manipulation is detected.

3-27. A game machine provided with a casing (e.g., front frame 2) and a play field (7) having a winning region (e.g., respective winning holes 30A–30F) into which a play medium (e.g., a ball) can enter to achieve a win includes: a shooting start detection unit (e.g., S4) which detects an input from a user to start shooting the play media; a shooting device (e.g., ball shooting device 45) which shoots the play media into the play field; a shooting control unit (e.g., microcomputer 44) which automatically determines shooting strength of the play media by the shooting device, and starts control for shooting the play media in response to the shooting start detection unit detecting the input from the user to start shooting the play media; and a strength change detection unit (e.g., sensor 39) which detects a manipulation for changing the shooting strength of the shooting device. The shooting control unit includes an adjustment unit (e.g., see FIG. 15) which adjusts the shooting strength of the shooting device in accordance with the detected result of the strength change detection unit.

3-28. In the process illustrated in FIG. 6, the value of the available ball counter is decremented by 1 every time a ball is shot (S10), and determination is made whether the value of the counter has reached 0 S6) to decide whether all the available balls have been shot. Alternatively, a first counter storing the number of available balls for shooting and a second counter counting the number of balls having been shot may be provided, with only the value of the second counter being incremented by 1 for each ball shot. In this case, decision as to whether all the available balls have been shot can be made by determining whether the values of the first counter and the second counter match with each other.

3-29. As described above, game machine 10 described as the second embodiment may be provided with a button (e.g., shooting stop button) with which ball shooting can be stopped at an arbitrary timing before all the balls set are shot, as in game machine 1 described as the first embodiment. In this case, the game machine 10 described as the second embodiment realizes a game machine having the following features.

The game machine (10) provided with a casing (e.g., front frame 2) and a play field (7) having a winning region (e.g., respective winning holes 34A–34E) into which a play medium (e.g., a ball) can enter to achieve a win includes: a shooting count selection unit (e.g., ball count select buttons 270A–270F) with which a player can select one of a predetermined number of different plural numbers as a shooting count of the play media; a shooting count setting unit which sets the plural number selected by the player via the shooting count selection unit as the shooting count for one game; a shooting count storage unit which stores the number of available play media for shooting into the play field (e.g., an available ball counter for storing the number of available balls that is to be displayed on BALL REMAINING display portion 216); a start detection unit which detects an input from the user (e.g., manipulation of start button 230) to start shooting the play media into the play field; a shooting control unit which initiates shooting the play media into the play field in response to the start detection unit detecting the input from the user to start shooting the play media, and controls to stop shooting the play media in response to all the available play media having been shot; and a stop detection unit which detects an input from the user to stop shooting the play media (e.g., the shooting stop button described in the second embodiment as the modification thereof). The shooting control unit can control to start the shooting operation of the play media into the play field when a shooting count of a maximum number selectable is selected by manipulation of the shooting count selection unit (e.g., manipulation of ball count select button (max ball button) 270F), even if the input from the user to start shooting the play media is undetected. It can also control to stop shooting the play media in response to the stop detection unit detecting the input from the user to stop shooting the play media.

3-30. In the embodiments described above, the route of the ball can be changed by touching touch screen 60 provided on the play field. Alternatively, a manipulation switch for adjustment of ball shooting strength may be provided in the game machine to allow the route of the ball to be changed by manipulation of the manipulation switch by the player. For example, a slide switch designed to increase the shooting strength by sliding it in one direction and to decrease the shooting strength by sliding it in an opposite direction, or a push switch designed to increase the shooting strength by applying more pressure to make it further depressed, can be employed as the manipulation switch. Alternatively, a sensor such as an infrared sensor sensing an infrared signal generated by a remote controller may be provided in the game machine to allow the flipped balls to converge on a position designated by manipulation of the controller. Yet alternatively, manipulation switches corresponding to respective winning holes, or manipulation switches corresponding to different positions of the play field may be provided in the game machine to allow the flipped balls to converge on a winning hole or a position of the play field that is designated by manipulation of the relevant manipulation switch.

3-31. In the first embodiment, the specific play state is terminated after winning hole 30B, for example, repeatedly changes between the first state advantageous to the player allowing entry of a ball into the hole and the second state disadvantageous to the player inhibiting entry of the ball into the hole over a predetermined period of time. When a stop manipulation is detected during the specific play state, the ball shooting is stopped when the specific play state is finished (at the time point when the winning hole 30B has finished to change from the first state to the second state).

In this case, the ball shooting may be stopped exactly at the time point when the specific play state is finished, or immediately before the end of the specific play state. Alternatively, the ball shooting may be stopped immediately after the end of the specific play state.

For example, the time required for a flipped ball to arrive at the winning hole 30B may be taken into consideration, and the ball shooting may be stopped ahead of the end of the specific play state by the relevant arrival time of the ball. With such a configuration, any ball is prevented from reaching winning hole 30B after closing thereof, which is more effective to avoid wasteful shooting of the balls.

In particular, in the case of the game machine having balls displayed as images, the ball shooting may be stopped immediately after display of the image of shooting a ball that is predetermined to enter the winning hole 30B lastly in the specific play state.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A game machine provided with a casing and a play field having a winning region into which a play medium can enter to achieve a win, comprising:

storage means for storing the number of available play media for shooting into said play field;

start detection means for detecting an input from a user to start shooting the play media into said play field;

shooting control means for initiating shooting the play media into said play field in response to said start detection means detecting the input from the user to start shooting the play media, and controlling to stop shooting the play media in response to all the available play media having been shot; and stop detection means for detecting an input from the user to temporarily stop shooting the play media;

wherein said shooting control means controls to pause shooting the play media in response to said stop detection means detecting the input from the user to temporarily stop shooting the play media before all the available play media are shot.

2. The game machine according to claim 1, further comprising display means for displaying the number of the available play media stored in said storage means in an identifiable manner.

3. The game machine according to claim 1, further comprising accounting detection means for detecting a manipulation for settling a play result, wherein said shooting control means controls to stop shooting the play media in response to said accounting detection means detecting the manipulation for settling the play result.

4. The game machine according to claim 1, wherein said shooting control means controls to resume shooting the play media if additional available play media are added within a predetermined period of time after the shooting of the play media is stopped in response to all the available play media having been shot.

5. The game machine according to claim 1, wherein said play field, said play medium and said winning region are displayed as images by an image display device mounted to said game machine.

6. The game machine according to claim 5, further comprising selection detection means for detecting a selection of the play field, wherein said image display device displays one of a predetermined number of different play fields in accordance with the selection detected by said selection detection means.

7. The game machine according to claim 1, further comprising:

first input means for the user to enter the input to start shooting the play media; and second input means for the user to enter the input to temporarily stop shooting the play media;

wherein said first input means and said second input means are formed of a transparent electrode films.

* * * * *